US011359792B2

(12) United States Patent
Wakafuji

(10) Patent No.: US 11,359,792 B2
(45) Date of Patent: Jun. 14, 2022

(54) LIGHTING DEVICE

(71) Applicant: Nichia Corporation, Anan (JP)

(72) Inventor: Akiyoshi Wakafuji, Chino (JP)

(73) Assignee: NICHIA CORPORATION, Anan (JP)

( * ) Notice: Subject to any disclaimer, the term of this patent is extended or adjusted under 35 U.S.C. 154(b) by 24 days.

(21) Appl. No.: 16/987,009

(22) Filed: Aug. 6, 2020

(65) Prior Publication Data

US 2021/0041083 A1 Feb. 11, 2021

(30) Foreign Application Priority Data

Aug. 6, 2019 (JP) ..... JP2019-144826
May 21, 2020 (JP) ..... JP2020-088636

(51) Int. Cl.
*F21V 7/00* (2006.01)
*F21S 41/33* (2018.01)
*F21Y 115/10* (2016.01)

(52) U.S. Cl.
CPC ..... *F21V 7/0025* (2013.01); *F21S 41/337* (2018.01); *F21Y 2115/10* (2016.08)

(58) Field of Classification Search
CPC ..... F21V 7/0025; F21S 41/334; F21S 41/337
See application file for complete search history.

(56) References Cited

U.S. PATENT DOCUMENTS 6,000,816 A 12/1999 Serizawa et al.
6,508,574 B1 1/2003 Sara et al.
2005/0141233 A1* 6/2005 Matsumoto ..... F21S 41/334 362/517
2009/0284979 A1 11/2009 Iwasaki
2009/0284980 A1* 11/2009 Iwasaki ..... F21S 41/43 362/517
2009/0284981 A1 11/2009 Iwasaki
2010/0008088 A1 1/2010 Koizumi et al.
2013/0235576 A1 9/2013 McGowan et al.
2015/0226401 A1 8/2015 Ferrier
2017/0153000 A1* 6/2017 Sato ..... F21S 41/147
(Continued)

FOREIGN PATENT DOCUMENTS

CN 202101152 U 1/2012
EP 2715218 A2 4/2014
EP 2947384 A1 11/2015
(Continued)

*Primary Examiner* — Rajarshi Chakraborty
*Assistant Examiner* — Nathaniel J Lee
(74) *Attorney, Agent, or Firm* — Mori & Ward, LLP

(57) ABSTRACT

A lighting device includes a first light emitting part including a first light source part and a first optical part that includes a first reflecting part and a second reflecting part. A first direction from the first reflecting part to the second reflecting part crosses a second direction from the first light source part to the second reflecting part. A direction from the first light source part to the first reflecting part is along a first plane which includes the first direction and the second direction, and crosses the second direction. A distance between the first reflecting part and the first light source part is larger than a distance between the second reflecting part and the first light source part. A light distribution angle of a first-reflecting-part light in the first plane is larger than the light distribution angle of the second-reflecting-part light in the first plane.

24 Claims, 21 Drawing Sheets

(56) References Cited

U.S. PATENT DOCUMENTS

| | | | |
|---|---|---|---|
| 2017/0159902 | A1 | 6/2017 | Yamamoto |
| 2019/0137052 | A1 | 5/2019 | Hwang |

FOREIGN PATENT DOCUMENTS

| | | | |
|---|---|---|---|
| JP | H10-050105 | A | 2/1998 |
| JP | 2002-245811 | A | 8/2002 |
| JP | 2004-185912 | A | 7/2004 |
| JP | 2009-277480 | A | 11/2009 |
| JP | 2009-277481 | A | 11/2009 |
| JP | 2009-277482 | A | 11/2009 |
| JP | 2010-021001 | A | 1/2010 |
| JP | 2010-021002 | A | 1/2010 |
| JP | 2017-107684 | A | 6/2017 |
| JP | 2018-170096 | A | 11/2018 |
| JP | 2018-206704 | A | 12/2018 |
| JP | 2019-153412 | A | 9/2019 |
| JP | 2019-153413 | A | 9/2019 |
| WO | 2002/035146 | A1 | 5/2002 |
| WO | 2016/024489 | A1 | 2/2016 |

* cited by examiner

FIG. 31

| Dy1 (m) | Dx3 (m) | Dh1 (m) | Dh2 (m) | Dx3 X Dh3 (m) | AvIL (lx) | CD |
|---|---|---|---|---|---|---|
| 0.0975 | 0.53 | 0.16 | 1.24 | 0.53 × 1.1 | 3552 | 0.089 |
| 0.125 | 0.68 | 0.20 | 1.59 | 0.68 × 1.4 | 2161 | 0.114 |
| 0.25 | 1.4 | 0.40 | 3.18 | 1.4 × 2.8 | 540 | 0.228 |
| 0.5 | 2.7 | 0.80 | 6.35 | 2.7 × 5.6 | 135 | 0.456 |
| 0.75 | 4.1 | 1.20 | 9.5 | 4.1 × 8.3 | 60 | 0.683 |
| 1.0 | 5.4 | 1.59 | 12.7 | 5.4 × 11.1 | 34 | 0.911 |
| 1.0975 | 5.9 | 1.75 | 13.9 | 5.9 × 12.2 | 28 | 1.000 |
| 1.5 | 8.1 | 2.39 | 19.1 | 8.1 × 16.7 | 15 | 1.367 |
| 2.0 | 10.8 | 3.19 | 25.4 | 10.8 × 22.2 | 8.4 | 1.822 |
| 2.5 | 13.5 | 3.99 | 31.8 | 13.5 × 27.8 | 5.4 | 2.278 |
| 3.0 | 16.2 | 4.78 | 38.1 | 16.2 × 33.3 | 3.8 | 2.733 |
| 3.5 | 18.9 | 5.58 | 44.5 | 18.9 × 38.9 | 2.8 | 3.189 |
| 4.0 | 21.7 | 6.38 | 50.8 | 21.7 × 44.4 | 2.1 | 3.645 |
| 4.5 | 24.4 | 7.17 | 57.2 | 24.4 × 50 | 1.67 | 4.100 |
| 5.0 | 27.1 | 7.97 | 63.5 | 27.1 × 55.6 | 1.35 | 4.556 |

LIGHTING DEVICE

CROSS-REFERENCE TO RELATED APPLICATION

This application claims priority to Japanese Patent Application No. 2019-144826 filed on Aug. 6, 2019, and Japanese Patent Application No. 2020-088636 filed on May 21, 2020, the disclosures of which are hereby incorporated by reference in their entireties.

BACKGROUND

The present disclosure relates to a lighting device.

For example, a lighting device is used to illuminate various objects such as a road, wall, or indoor space. Ina lighting device, there is a need to improve the brightness uniformity across an illuminated surface. See, for example, Japanese Patent Publication No. 2018-206704.

SUMMARY

The present disclosure may provide a lighting device capable of achieving an improved brightness uniformity across an illuminated surface.

According to one embodiment of the present disclosure, a lighting device includes a first light emitting part including a first optical part and a light source part. The first optical part includes a first reflecting part and a second reflecting part. A first direction extending from the first reflecting part to the second reflecting part crosses a second direction extending from the first light source part to the second reflecting part. A direction extending from the first light source part to the first reflecting part extends along a first plane which includes the first direction and the second direction, and crosses the second direction. A distance between the first reflecting part and the first light source part is larger than a distance between the second reflecting part and the first light source part. A light distribution angle of a first-reflecting-part light, that is a portion of a first outgoing light from the first light source part reflected by the first reflecting part, in the first plane is larger than a light distribution angle of a second-reflecting-part light, that is a portion of the first outgoing light reflected by the second reflecting part, in the first plane.

According to the embodiment of the present disclosure, a lighting device capable of achieving an improved brightness uniformity across an illuminated surface may be provided.

BRIEF DESCRIPTION OF THE DRAWINGS

FIG. 31 is a table of the characteristics of a lighting device according to one embodiment.

DETAILED DESCRIPTION

Figure 1:
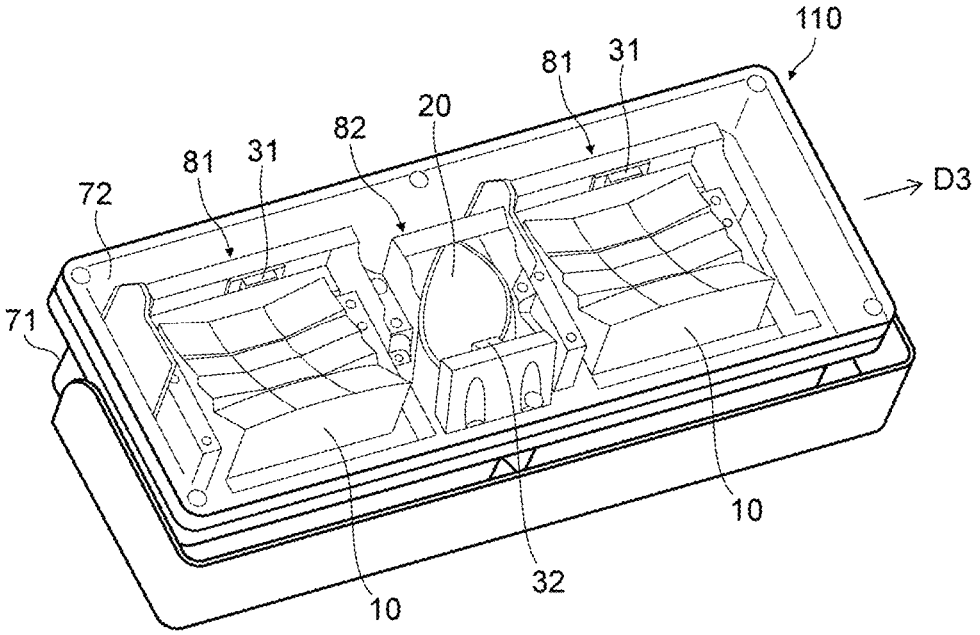
FIG. 1 is a schematic perspective view illustrating a lighting device according to a first embodiment.

Certain embodiments of the present disclosure will be explained below with reference to the accompanying drawings.

The drawings are schematic or conceptual in nature, and as such, the relationship between the thickness and the width of each part, and the ratio of the size of one part to the size of another part are not necessarily the same as those in an actual structure. Moreover, depending on the drawing, even the same part might be shown in a different size or ratio.

In the description herein, similar elements to those described with reference to a previously described drawing will be denoted with the same reference numerals for which detailed description will be omitted as appropriate.

First Embodiment

FIG. 1 is a schematic perspective view illustrating a lighting device according to a first embodiment.

Figure 2:
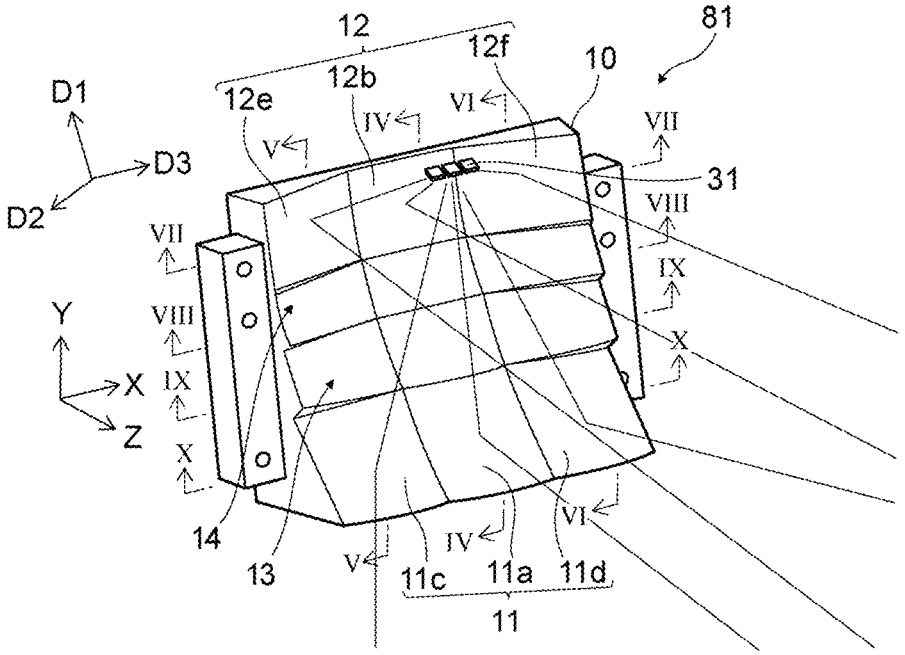
FIG. 2 is a schematic perspective view illustrating a portion of the lighting device according to the first embodiment.

FIG. 2 is a schematic perspective view illustrating a portion of the lighting device according to the first embodiment.

Figure 3:
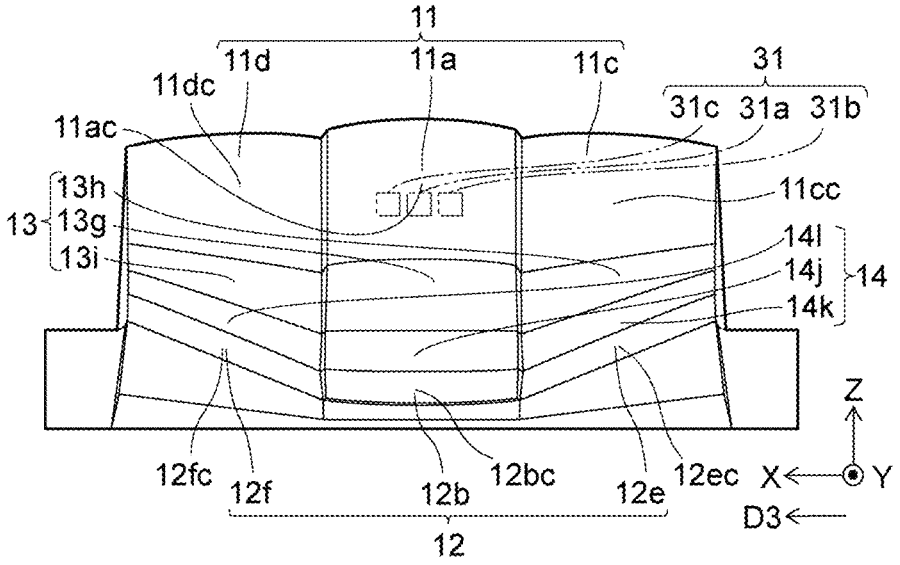
FIG. 3 is a schematic plan view illustrating a portion of the lighting device according to the first embodiment.

FIG. 3 is a schematic plan view illustrating a portion of the lighting device according to the first embodiment.

FIG. 4 to FIG. 10 are schematic sectional views each illustrating a portion of the lighting device according to the first embodiment.

FIG. 4 to FIG. 10 respectively show schematic sectional views taken along lines IV-IV, V-V, VI-VI, VII-VII, VIII-VIII, IX-IX, and X-X in FIG. 2.

As shown in FIG. 1, the lighting device 110 related to the first embodiment includes a first light emitting part 81. The lighting device 110 can include a plurality of first light emitting parts 81. The lighting device 110 can include a second light emitting part 82. The second light emitting part 82 will be described later.

As shown in FIG. 1 and FIG. 2, the first light emitting part 81 includes a first optical part 10 and a first light source part 31. The first light source part 31 includes, for example, a light emitting diode (LED).

As shown in FIG. 3, the first light source part 31 can include a plurality of light sources, such as a first light source 31*a*, a second light source 31*b*, a third light source 31*c* and the like. The first light source 31*a*, the second light source 31*b*, and the third light source 31*c* each includes an LED, for example. In this example, the first light source 31*a* is located between the second light source 31*b* and the third light source 31*c*. Light is output from each light source.

The first light source part 31 can be located at the central position of the first light source part 31. For example, the position of the first light source part 31 can be substantially the central position of the first light source 31*a*.

As shown in FIG. 2, the first optical part 10 includes a first reflecting part 11 and a second reflecting part 12. As such, the first optical part 10 includes a plurality of reflecting parts. In this example, the first optical part 10 further includes a third reflecting part 13 and a fourth reflecting part 14. At least one portion of the third reflecting part 13 is located between the first reflecting part 11 and the second reflecting part 12. At least one portion of the fourth reflecting part 14 is located between the third reflecting part 13 and the second reflecting part 12. The number of reflecting parts provided in the first optical part 10 can be appropriately determined.

As shown in FIG. 2, the first reflecting part 11 includes a first reflecting face 11*a*, and the second reflecting part 12 includes a second reflecting face 12*b*. In this example, the first reflecting part 11 includes a third reflecting face 11*c* and a fourth reflecting face 11*d*. For example, at least one portion of the first reflecting face 11*a* is located between the third reflecting face 11*c* and the fourth reflecting face 11*d*. The second reflecting part 12 includes a fifth reflecting face 12*e* and a sixth reflecting face 12*f*. For example, at least one portion of the second reflecting face 12*b* is located between the fifth reflecting face 12*e* and the sixth reflecting face 12*f*. The number of reflecting faces provided in each of the first reflecting part 11 and the second reflecting part 12 can be appropriately determined.

Practically, the first reflecting part 11 can be located at the central position of the first reflecting part 11. For example, the first reflecting part 11 can substantially be located at the center 11*ac* of the first reflecting face 11*a* (see FIG. 4).

Practically, the second reflecting part 12 can be located at the central position of the second reflecting part 12. For example, the position of the second reflecting part 12 can substantially be the center 12*bc* of the second reflecting face 12*b* (see FIG. 4).

Figure 4:
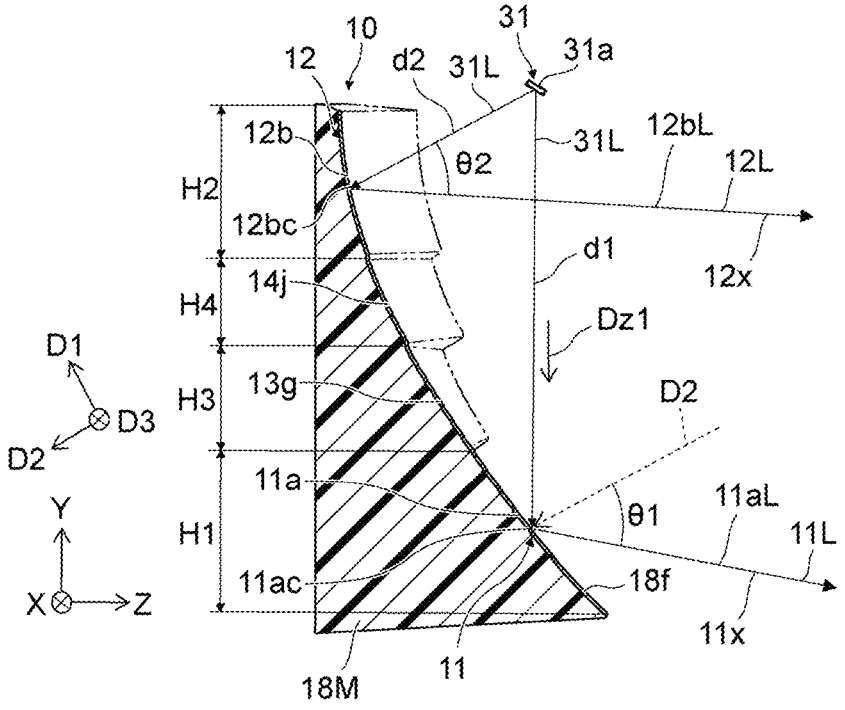
FIG. 4 is a schematic sectional view illustrating a portion of the lighting device according to the first embodiment.

As shown in FIG. 2 and FIG. 4, the direction from the first reflecting part 11 to the second reflecting part 12 is assumed as a first direction D1. As shown in FIG. 4, the direction from the center 11*ac* of the first reflecting face 11*a* to the center 12*bc* of the second reflecting face 12*b* corresponds to the first direction D1.

As shown in FIG. 2 and FIG. 4, the direction from the first light source part 31 to the second reflecting part 12 is assumed as a second direction D2. The first direction D1 crosses the second direction D2. For example, the second direction D2 corresponds to the direction from the center of the first light source 31*a* of the first light source part 31 to the center 12*bc* of the second reflecting face 12*b*.

As shown in FIG. 4, the direction Dz1 from the first light source part 31 to the first reflecting part 11 is along a first plane which includes the first direction D1 (i.e., the D1-D2 plane) and the second direction D2. The direction Dz1 crosses the second direction D2. In other words, using the position of the first light source part 31 as a reference, the direction to the second reflecting part 12 and the direction to the first reflecting part 11 are different from one another. The direction Dz1 from the first light source part 31 to the first reflecting part 11 corresponds to the direction from the central position of the first light source part 31 to the central position of the first reflecting part 11.

For example, the direction perpendicular to the first plane (the D1-D2 plane) which includes the first direction D1 and the second direction D2 is assumed as a third direction D3.

As will be described later, the lighting device 110 illuminates, for example, a surface referred to as an illuminated surface. The light outgoing from the lighting device 110 is incident on the illuminated surface. The illuminated surface can be a road as one example. In this case, the lighting device is disposed on a lateral face crossing the illuminated surface (i.e., the surface of the road). The lateral face is a surface such as a sidewall. The road is illuminated by the lighting device 110.

For example, the direction from the bottom to the top of the lateral face is assumed as a Y-axis direction (see FIG. 2). The Y-axis direction is, for example, substantially perpendicular to the surface of the road. The direction from the bottom edge of the lateral face to the road is assumed as a Z-axis direction (see FIG. 2). The Z-axis direction corresponds to the direction from the side of the road to the center of the road. At any focused position on the road, the direction in which the road extends is assumed as an X-axis direction (see FIG. 2). The Y-axis direction, the Z-axis direction, and the X-axis direction orthogonal with one another.

For example, the third direction D3 is along the X-axis direction. The first plane (the D1-D2 plane) which includes the first direction D1 and the second direction D2 is, for example, perpendicular to the X-axis direction. For example, the first direction D1 is oblique to the Z-axis direction. For example, the second direction D2 is also oblique to the Z-axis direction.

For example, as shown in FIG. 3, the position of the first reflecting face 11*a* in the third direction D3 is located between the position of the third reflecting face 11*c* in the third direction D3 and the position of the fourth reflecting face 11*d* in the third direction D3.

Figure 10:
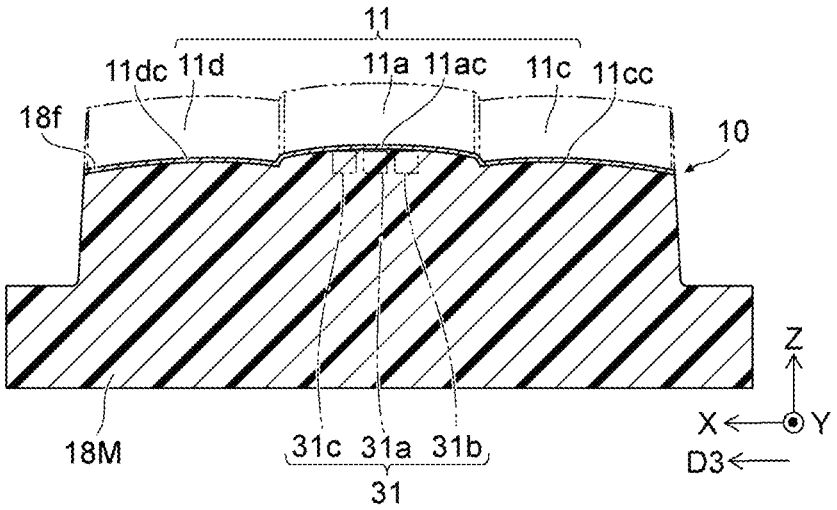
FIG. 10 is a schematic sectional view illustrating a portion of the lighting device according to the first embodiment.

FIG. 10 corresponds to a cross section taken along the Z-X plane which includes the center of the first reflecting part 11 in the Y-axis direction. The first reflecting face 11*a* in the third direction D3 can practically be at the center 11*ac* of the first reflecting face 11*a* in the third direction D3 (see FIG. 3 and FIG. 10). The third reflecting face 11*c* in the third direction D3 can practically be at the center 11*cc* of the third reflecting face 11*c* in the third direction D3 (see FIG. 3 and FIG. 10). The position of the fourth reflecting face 11*d* in the third direction D3 can practically be at the center 11*dc* of the fourth reflecting face 11*d* in the third direction D3 (see FIG. 3 and FIG. 10).

For example, as shown in FIG. 3, the position of the second reflecting face 12*b* in the third direction D3 is between the position of the fifth reflecting face 12*e* in the third direction D3 and the position of the sixth reflecting face 12*f* in the third direction D3.

Figure 7:
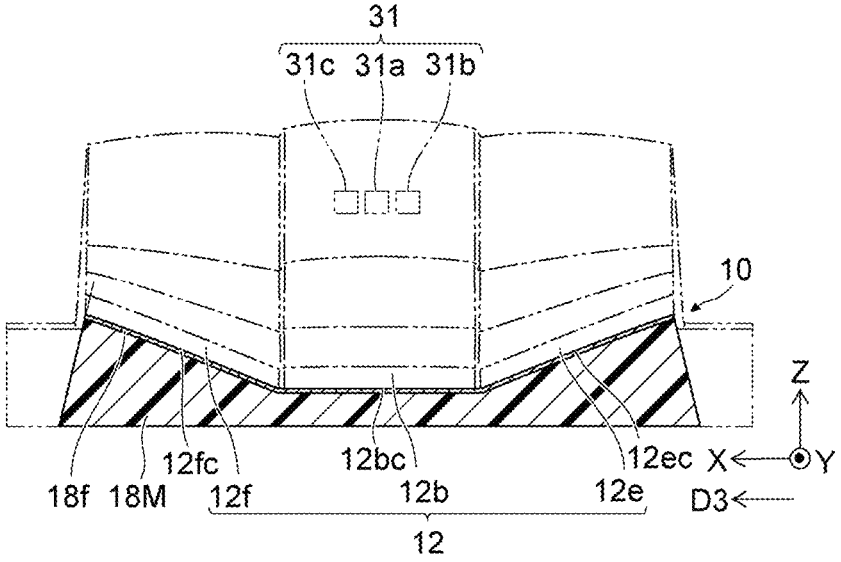
FIG. 7 is a schematic sectional view illustrating a portion of the lighting device according to the first embodiment.

FIG. 7 corresponds to across section taken along the Z-X plane that includes the center of the second reflecting part 12 in the Y-axis direction. The position of the second reflecting face 12*b* in the third direction D3 can practically be at the center 12*bc* of the second reflecting face 12*b* in the third direction D3 (see FIG. 3 and FIG. 7). The position of the fifth reflecting face 12*e* in the third direction D3 can practically be at the center 12*ec* of the fifth reflecting face 12*e* in the third direction D3 (see FIG. 3 and FIG. 7). The position of the sixth reflecting face 12*f* in the third direction D3 can practically be at the center 12*fc* of the sixth reflecting face 12*f* in the third direction D3 (see FIG. 3 and FIG. 7).

As shown in FIG. 3, the third reflecting part 13 is located, for example, between the first reflecting part 11 and the second reflecting part 12. The third reflecting part 13 includes, for example, a seventh reflecting face 13*g*, an eighth reflecting face 13*h*, and a ninth reflecting face 13*i*. For example, at least one portion of the seventh reflecting face 13*g* is located between the first reflecting face 11*a* and the second reflecting face 12*b*. At least one portion of the eighth reflecting face 13*h* is located between the third reflecting face 11*c* and the fifth reflecting face 12*e*. At least one portion of the ninth reflecting face 13*i* is located between the fourth reflecting face 11*d* and the sixth reflecting face 12*f*. The position of the seventh reflecting face 13*g* in the third direction D3 is between the position of the eighth reflecting face 13*h* in the third direction D3 and the position of the ninth reflecting face 13*i* in the third direction D3. The number of reflecting faces provided in the third reflecting part 13 can be appropriately determined.

Figure 9:
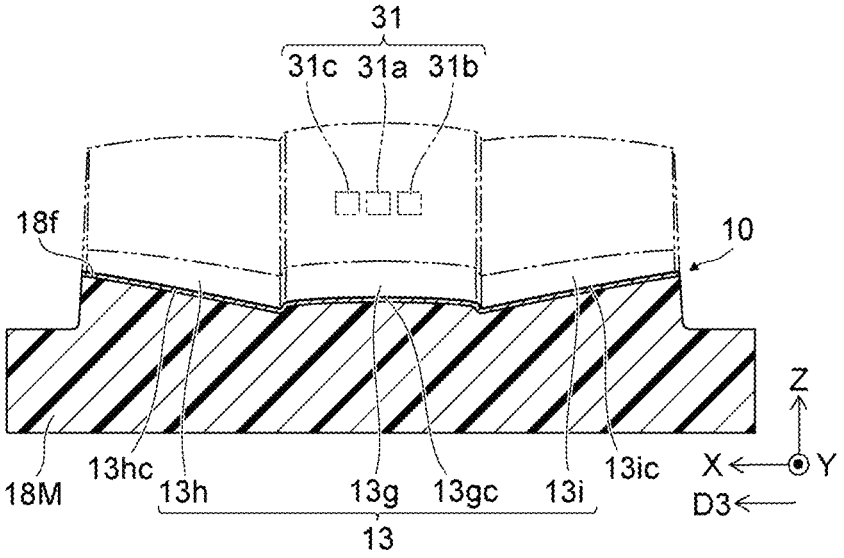
FIG. 9 is a schematic sectional view illustrating a portion of the lighting device according to the first embodiment.

FIG. 9 corresponds to a cross section taken along the Z-X plane which includes the center of the third reflecting part 13 in the Y-axis direction. The position of the seventh reflecting face 13*g* in the third direction D3 can practically be at the center 13*gc* of the seventh reflecting face 13*g* in the third direction D3 (see FIG. 9). The position of the eighth reflecting face 13*h* in the third direction D3 can practically be at the center 13*hc* of the eighth reflecting face 13*h* in the third direction D3 (see FIG. 9). The position of the ninth reflecting face 13*i* in the third direction D3 can practically be at the center 13*ic* of the ninth reflecting face 13*i* in the third direction D3 (see FIG. 9).

As shown in FIG. 3, the fourth reflecting part 14 is located, for example, between the third reflecting part 13 and the second reflecting part 12. The fourth reflecting part 14 includes, for example, a tenth reflecting face 14*j*, an eleventh reflecting face 14*k*, and a twelfth reflecting face 14*l*. For example, at least one portion of the tenth reflecting face 14*j* is located between the seventh reflecting face 13*g* and the second reflecting face 12*b*. At least one portion of the eleventh reflecting face 14*k* is located between the eighth reflecting face 13*h* and the fifth reflecting face 12*e*. At least one portion of the twelfth reflecting face 14*l* is located between the ninth reflecting face 13*i* and the sixth reflecting face 12*f*. The position of the tenth reflecting face 14*j* in the third direction D3 is between the position of the eleventh reflecting face 14*k* in the third direction D3 and the position of the twelfth reflecting face 14*l* in the third direction D3. The number of reflecting faces provided in the fourth reflecting part 14 can be appropriately determined.

Figure 8:
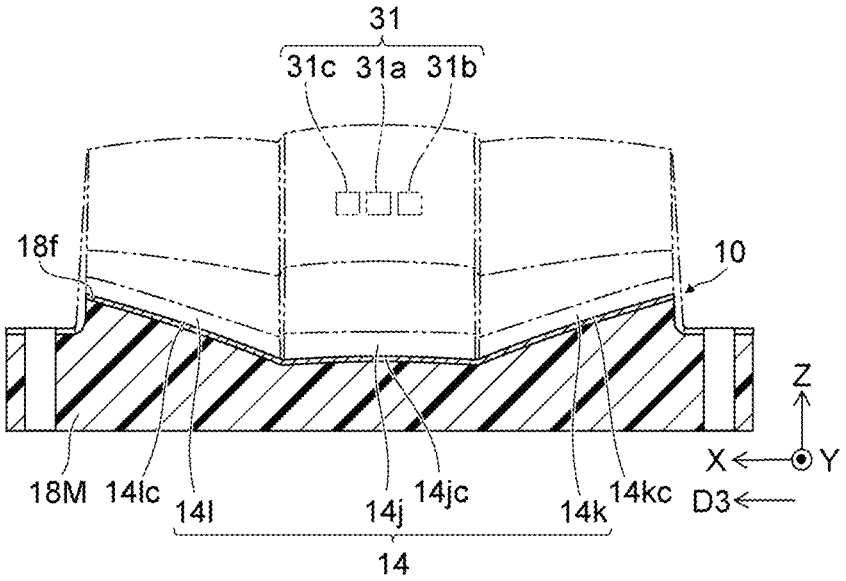
FIG. 8 is a schematic sectional view illustrating a portion of the lighting device according to the first embodiment.

FIG. 8 corresponds to a cross section taken along the Z-X plane which includes the center of the fourth reflecting part 14 in the Y-axis direction. The position of the tenth reflecting face 14*j* in the third direction D3 can practically be at the center 14*jc* of the tenth reflecting face 14*j* in the third direction D3 (see FIG. 8). The position of the eleventh reflecting face 14*k* in the third direction D3 can practically be at the center 14*kc* of the eleventh reflecting face 14*k* in the third direction D3 (see FIG. 8). The position of the twelfth reflecting face 14*l* in the third direction D3 can practically be at the center 141*c* of the twelfth reflecting face 14*l* in the third direction D3 (see FIG. 8).

The first to fourth reflecting parts 11 to 14 are, for example, discontinuous with one another. For example, multiple reflecting faces included in each of the first to fourth reflecting parts 11 to 14 are discontinuous with one another. For example, one or more steps are present between multiple reflecting faces included in each of the first to fourth reflecting parts 11 to 14. For example, one or more steps are present between the first to fourth reflecting parts 11 to 14.

As shown in FIG. 4 to FIG. 10, for example, a first reflecting film 18*f* can be used as the first optical part 10. In this example, the first reflecting film 18*f* is disposed on the surface of the first member 18M. For example, the first member 18M is provided with protrusions and depressions. The first reflecting film 18*f* is disposed on the surface having the protrusions and protrusions. The first member 18M can include, for example, a resin, glass, or metal. Resins include, for example, polybutylene terephthalate (PBT). Using a resin can simplify processing. The first reflecting film 18*f* includes a metal film such as an aluminum film, for example. Light is reflected by the surface of the first reflecting film 18*f*. For example, the first to fourth reflecting parts 11 to 14 include the first reflecting film 18*f* disposed on the surface of the first member 18M. For example, the first to fourth reflecting parts 11 to 14 correspond to the surface of the first reflecting film 18*f*. For example, the reflecting faces correspond to the surface of the first reflecting film 18*f*.

The light outgoing from the first light source part 31 is incident on the multiple reflecting parts included in the first optical part 10. The reflecting parts reflect the light outgoing from the first light emitting part 81. The reflected light is incident on the illuminated surface, for example, a road.

The light outgoing from the first light source part 31 is incident on multiple reflecting faces. The reflecting faces reflect the light outgoing from the first light emitting part 81. The reflected light is incident on the illuminated surface, for example, a road.

As shown in FIG. 4, the distance d1 between the first reflecting part 11 and the first light source part 31 is larger than the distance d2 between the second reflecting part 12 and the first light source part 31. The distance d1, for example, corresponds to the distance between the center 11*ac* of the first reflecting face 11*a* and the center of the first light source part 31. The distance d2, for example, corresponds to the distance between the center 12*bc* of the second reflecting face 12*b* and the center of the light source part 31.

Figure 11:
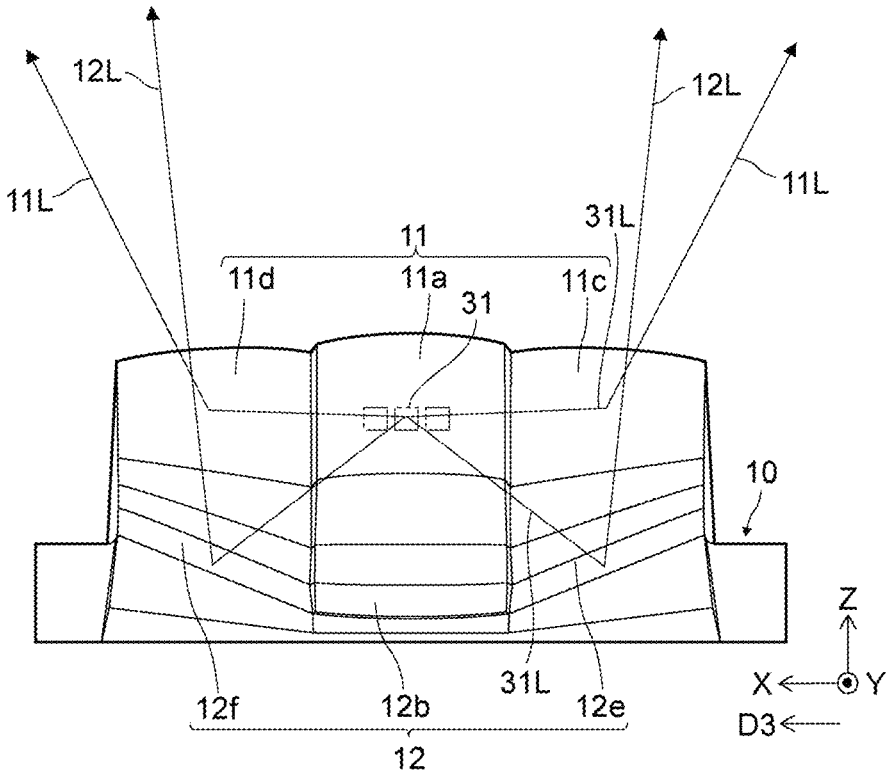
FIG. 11 is a schematic plan view illustrating the reflection of light in the lighting device according to the first embodiment.

FIG. 11 is a schematic plan view illustrating the reflection of light in the lighting device according to the first embodiment.

Figure 12:
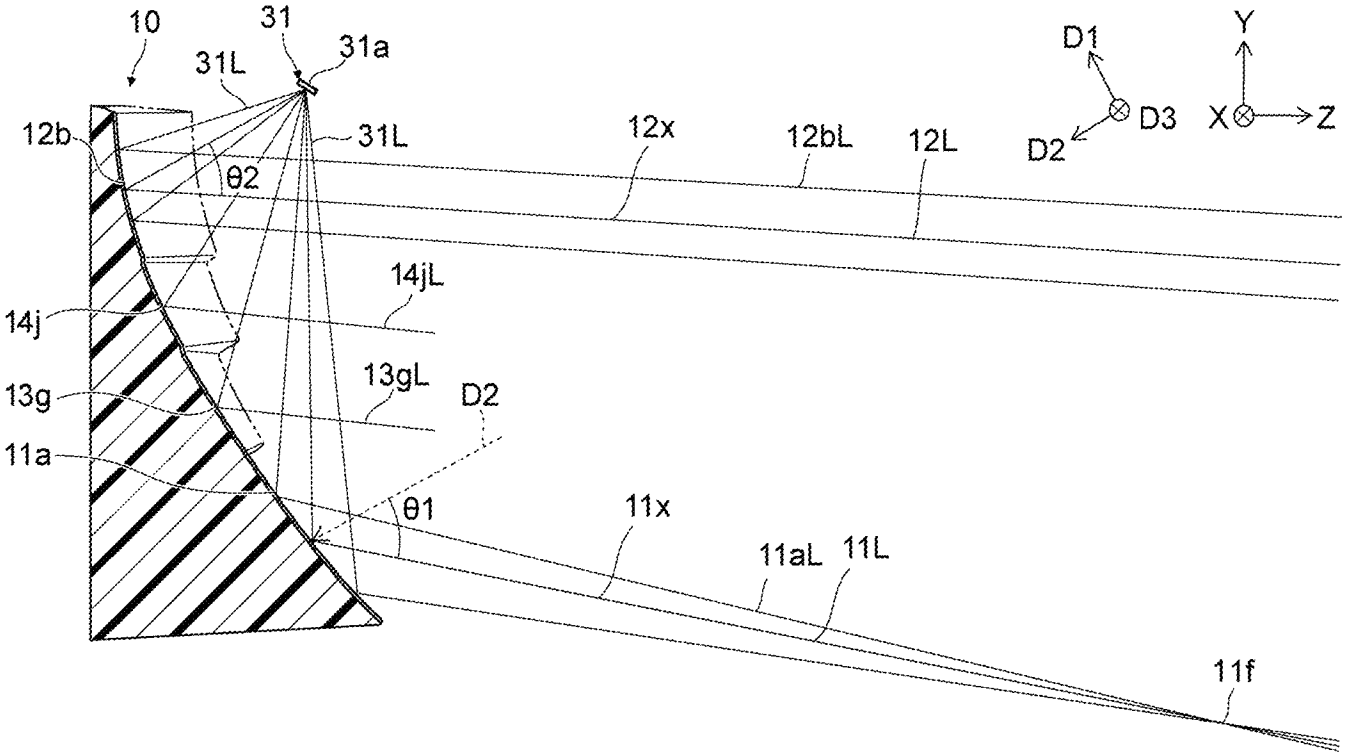
FIG. 12 is a schematic sectional view illustrating the reflection of light in the lighting device according to the first embodiment.

FIG. 12 is a schematic sectional view illustrating the reflection of light in the lighting device according to the first embodiment.

Figure 13:
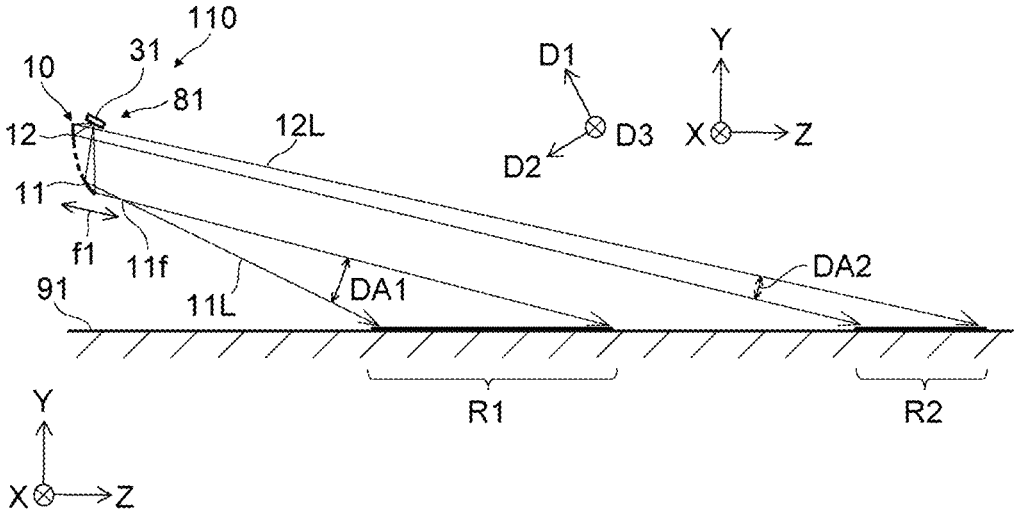
FIG. 13 is a schematic diagram illustrating the light in the lighting device according to the first embodiment.

FIG. 13 is a schematic diagram illustrating light in the lighting device according to the first embodiment.

As shown in FIG. 4 and FIG. 11, a portion of the first outgoing light 31L from the first light source part 31 is reflected by the first reflecting part 11, and then becomes the first-reflecting-part light 11L. A portion of the first outgoing light 31L from the first light source part 31 is reflected by the second reflecting part 12, and then becomes the second-reflecting-part light 12L.

As shown in FIG. 4 and FIG. 11, the first-reflecting-part light 11L includes, for example, first-reflecting-face light 11*a*L which is the first outgoing light 31L from the first light source part 31 reflected by the first reflecting face 11*a*. The second-reflecting-part light 12L includes, for example, second-reflecting-face light 12*b*L which is the first outgoing light 31L from the first light source part 31 reflected by the second reflecting face 12*b*.

As shown in FIG. 12 and FIG. 13, the light distribution angle DA1 of the first-reflecting-part light 11L in the first plane (the D1-D2 plane) is larger than the light distribution angle DA2 of the second-reflecting-part light 12L in the first plane. The light distribution angle DA1 corresponds, for example, to the light distribution angle of the first-reflecting-face light 11*a*L in the first plane (the D1-D2 plane). The light distribution angle DA2 corresponds, for example, to the light distribution angle of the second-reflecting-face light 12*b*L in the first plane (the D1-D2 plane). Alight distribution angle corresponds to an angle range for one half of the highest intensity of light (full width at half maximum).

As shown in FIG. 4 and FIG. 13, for example, the first reflecting part 11 has a first focal point 11*f* in the first plane (the D1-D2 plane). The distance from the first reflecting part 11 to the first focal point 11*f* corresponds to the first focal point distance f1 (see FIG. 13). As shown in FIG. 13, the first-reflecting-part light 11L is incident on the illuminated surface 91 after advancing through the focal point 11*f*.

On the other hand, the second reflecting part 12 has no focal point in the first plane (the D1-D2 plane). Alternatively, in the case in which the second reflecting part 12 has a focal point in the first plane (the D-D2 plane), the focal point distance of the second reflecting part 12 is larger than the first focal point distance f1.

As shown in FIG. 13, the first light emitting part 81 allows light (i.e., the first-reflecting-part light 11L, the second-reflecting-part light 12L, and the like) to be incident on the illuminated surface 91 from a side of the illuminated surface 91. The first-reflecting-part light 11L is incident on a first illuminated region R1 of the illuminated surface 91. The second-reflecting-part light 12L is incident on a second illuminated region R2 of the illuminated surface 91. The distance between at least one portion of the first illuminated region R1 and the first light emitting part 81 is smaller than the distance between the second illuminated region R2 and the first light emitting part 81.

The distance between the first illuminated region R1 and the first light emitting part 81 is smaller than the distance between the second illuminated region R2 and the first light emitting part 81. The first-reflecting-part light 11L is incident on the first illuminated region R1 in the illuminated surface 91. The second-reflecting-part light 12L is incident on the second illuminated region R2 in the illuminated surface 91.

In this embodiment, the first reflecting part 11 is located farther from the first light source part 31 than the second reflecting part 12 is. The second reflecting part 12 is located closer to the first light source part 31 than the first reflecting part 11 is. The light distribution angle DA1 of the first-reflecting-part light 11L reflected by the first reflecting part 11 is larger than the light distribution angle DA2 of the second-reflecting-part light 12L reflected by the second reflecting part 12. This can further improve the brightness uniformity in the illuminated surface 91.

The first-reflecting-part light 11L reflected by the first reflecting part 11 is incident on the first illuminated region R1 that is closer to the first light source part 31, and the second-reflecting-part light 12L reflected by the second reflecting part 12 is incident on the second illuminated region R2 in the illuminated surface 91. At this time, by setting the relationship between the light distribution angles described above, the brightness of the illuminated regions can be brought closer between closer region to and farther region from the first light source part 31. This can improve the brightness uniformity in the illuminated surface 91.

For example, there is a lighting device as a first reference example that illuminates an illuminated surface 91 such as a road from the above. In this case, the angle of incidence of the light outgoing from the lighting device to the illuminated surface 91 is small. In other words, the light is incident on the illuminated surface 91 at an angle close to perpendicular to the surface. The light is incident on the illuminated surface 91 with a small angle of incidence. In the case of such a first reference example, there is relatively small variation in the distance between the illuminated surface and the lighting device. It is therefore relatively easy to improve the brightness uniformity in the illuminated surface 91.

An automotive headlight, for example, can be cited as a second reference example that laterally illuminates an illuminated surface 91 such as a road. The angle of incidence of the light outgoing from the headlight to the illuminated surface 91 is relatively large. Such a second reference example is designed such that the light distribution angle of the light reflected by a reflecting part located farther from the light source is smaller than the light distribution angle of the light reflected by a reflecting part disposed closer to the light source. It was found that increasing the angle of incidence in such a second reference example made it difficult to improve the brightness uniformity in the illuminated surface 91. The automotive headlight design concept may addresses the point of brightly illuminating distant objects, however, generally has a difficulty in providing uniform brightness across a large area from a far region to a close region.

In contrast, the embodiment of the present disclosure can achieve brightness uniformity in the illuminated surface 91 even when the first light emitting part 81 allows the light to be incident on the illuminated surface 91 from a side of the illuminated surface 91 with a broad range of angles of incidence. In the embodiment of the present disclosure, the depression angle of the light outgoing from the first light emitting part 81 is in a range of, for example, about 1 to about 40 degrees. In the case of the second reference example such as an automotive headlight, the depression angle is in a range of about 1 to about 10 degrees. As described above, in the case of the second reference example, brightness uniformity is poor even with depression angles is in a range of 1 to 10 degrees. In contrast, in the embodiment of the present disclosure, uniform brightness can be achieved over a wide range of depression angles such as from 1 to 40 degrees.

The light reflected by other reflecting parts (e.g., the third reflecting part 13, the fourth reflecting part 14, and the like) is incident on the area between the first illuminated region R1 and the second illuminated region R2. A large area can be illuminated with uniform brightness.

As shown in FIG. 12, in the embodiment of the present disclosure, the depression angle of the first-reflecting-part light 11L is larger than the depression angle of the second-reflecting-part light 12L. For example, a first angle θ1 formed by the optical axis 11*x* of the first-reflecting-part light 11L and the second direction D2 is larger than a second angle 62 formed by the optical axis 12*x* of the second-reflecting-part light 12L and the second direction D2. When the first light emitting part 81 illuminates the illuminated surface 91 from a side of the illuminated surface 91, this relationship of angles allows the first-reflecting-part light 11L to be incident on a closer region in the illuminated surface 91, and the second-reflecting-part light 12L to be incident on a farther region in the illuminated surface 91.

FIG. 14 to FIG. 21 are schematic diagrams illustrating light distribution angles in the lighting device according to the first embodiment.

In FIG. 14 to FIG. 21, the horizontal axis represents light distribution angles LX (degrees) in the X-axis direction, and the vertical axis represents light distribution angles LY (degrees) in the Y-axis direction. A light distribution angle LX in the X-axis direction corresponds to a light distribution angle in the third direction D3 perpendicular to the first plane (the D1-D2 plane) which includes the first direction D1 and the second direction D2. A light distribution angle LY in the Y-axis direction corresponds to a light distribution angle in the first plane.

Figure 14:
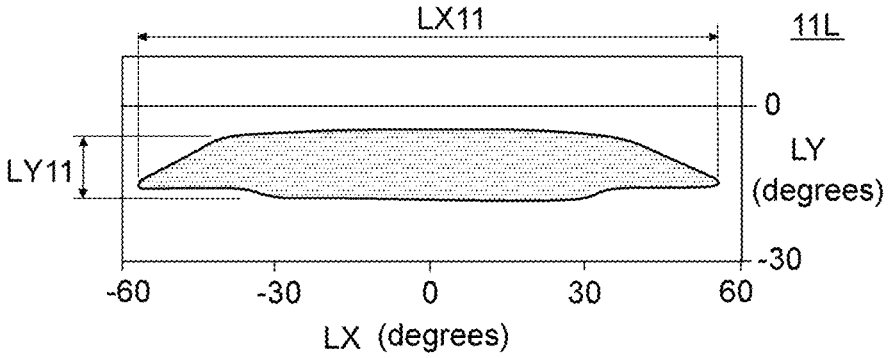
FIG. 14 is a schematic diagram illustrating a light distribution angle of light from the lighting device according to the first embodiment.

As shown in FIG. 14, the light distribution angle LX11 of the first-reflecting-part light 11L in the X-axis direction (i.e., the third direction D3) is larger than the light distribution angle LX12 described later. As previously explained, the light distribution angle LY11 of the first-reflecting-part light 11L in the Y-axis direction is larger than the light distribution angle LY12 described later.

Figure 17:
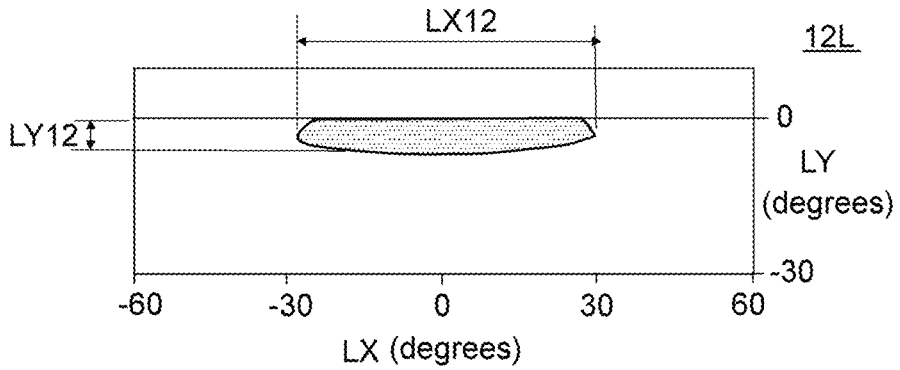
FIG. 17 is a schematic diagram illustrating a light distribution angle of light from the lighting device according to the first embodiment.

As shown in FIG. 17, the light distribution angle LX12 of the second-reflecting-part light 12L in the X-axis direction is smaller than the light distribution angle LX11. As previously explained, the light distribution angle LY12 of the second-reflecting-part light 12L in the Y-axis direction is smaller than the light distribution angle LY11.

Figure 15:
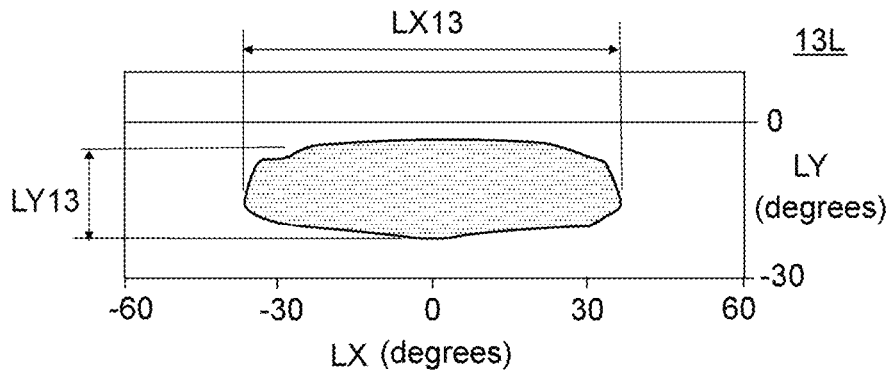
FIG. 15 is a schematic diagram illustrating a light distribution angle of light from the lighting device according to the first embodiment.

As shown in FIG. 15, the third-reflecting-part light 13L has a light distribution angle LX13 in the X-axis direction (i.e., the third direction D3) and a light distribution angle LY13 in the Y-axis direction. In one example, the light distribution angle LX13 is positioned between the light distribution angle LX11 and the light distribution angle LX12. In one example, the light distribution angle LY13 is positioned between the light distribution angle LY11 and the light distribution angle LY12.

Figure 16:
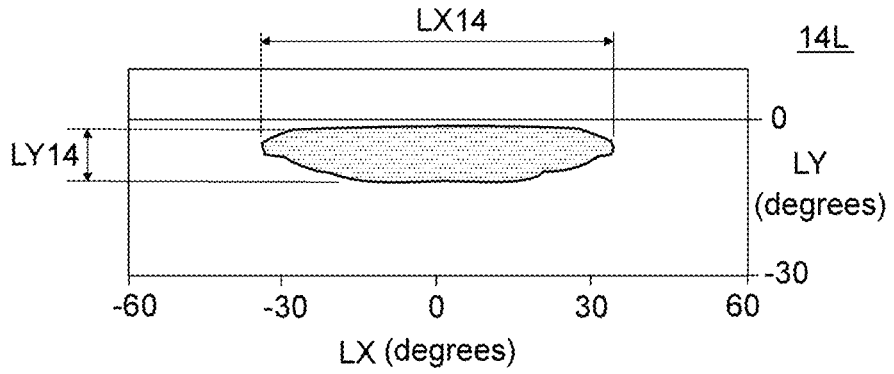
FIG. 16 is a schematic diagram illustrating a light distribution angle of light from the lighting device according to the first embodiment.

As shown in FIG. 16, the fourth-reflecting-part light 14L has a light distribution angle LX14 in the X-axis direction (i.e., the third direction D3) and a light distribution angle LY14 in the Y-axis direction. In one example, the light distribution angle LX14 is positioned between the light distribution angle LX13 and the light distribution angle LX12. In one example, the light distribution angle LY14 is positioned between the light distribution angle LY13 and the light distribution angle LY12.

The light distribution angle LX11 and the light distribution angle LYl1 correspond to the entire area of light distribution angles of the light beams reflected by the multiple reflecting faces included in the first reflecting part 1. The light distribution angle LX12 and the light distribution angle LY12 correspond to the entire area of light distribution angles of the light reflected by the multiple reflecting faces included in the second reflecting part 12. The light distribution angle LX13 and the light distribution angle LY13 correspond to the entire area of light distribution angles of the light reflected by the multiple reflecting faces included in the third reflecting part 13. The light distribution angle LX14 and the light distribution angle LY14 correspond to the entire area of light distribution angles of the light reflected by the multiple reflecting faces included in the fourth reflecting part 14.

Figure 18:
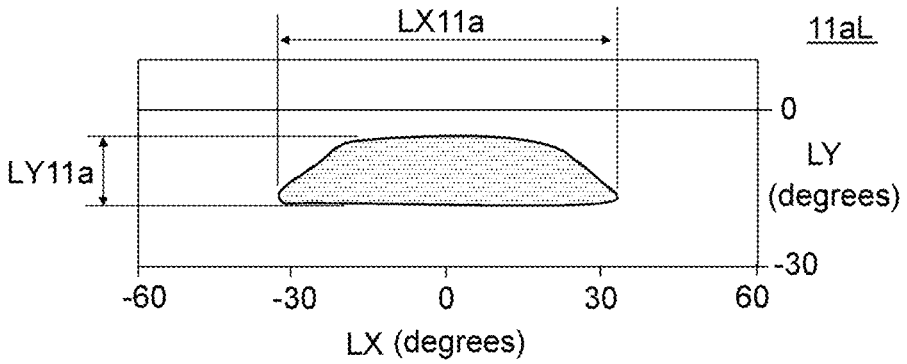
FIG. 18 is a schematic diagram illustrating a light distribution angle of light from the lighting device according to the first embodiment.
Figure 19:
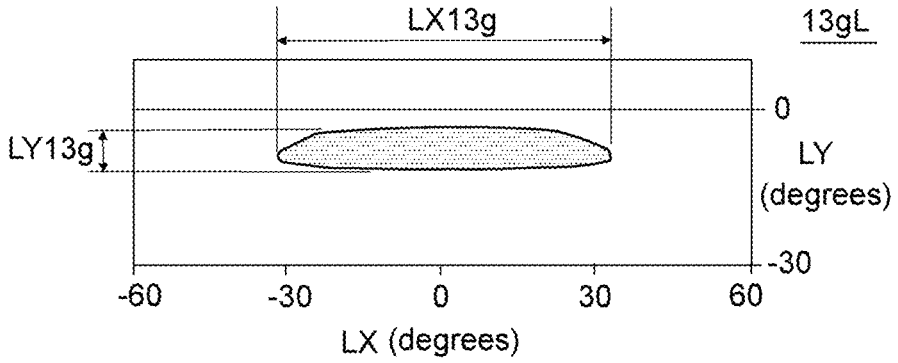
FIG. 19 is a schematic diagram illustrating a light distribution angle of light from the lighting device according to the first embodiment.
Figure 20:
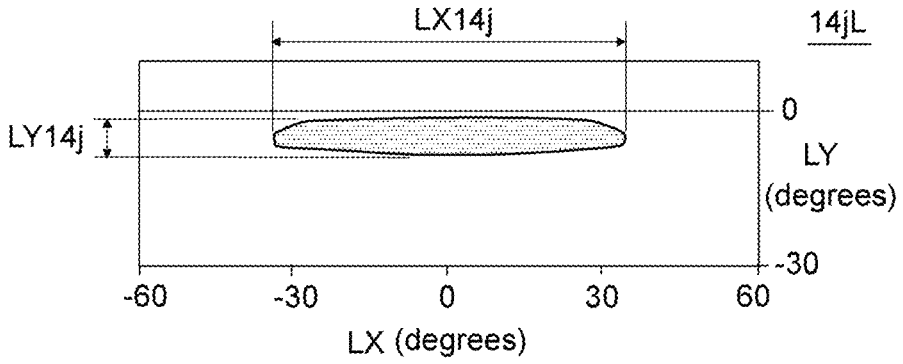
FIG. 20 is a schematic diagram illustrating a light distribution angle of light from the lighting device according to the first embodiment.
Figure 21:
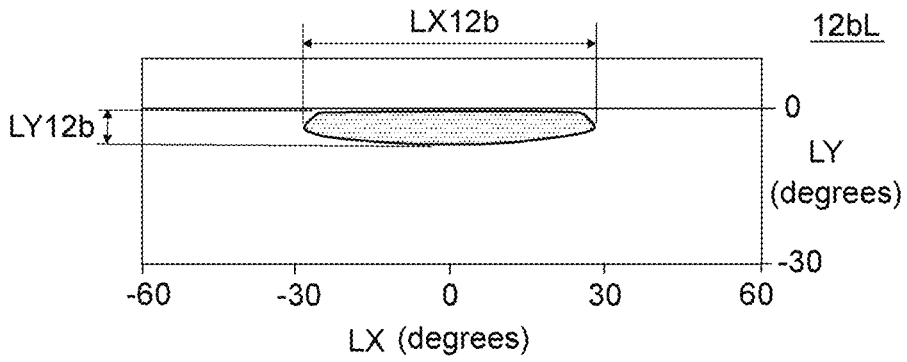
FIG. 21 is a schematic diagram illustrating a light distribution angle of light from the lighting device according to the first embodiment.

FIG. 18 illustrates the distribution angles of the first-reflecting-face light 11*a*L reflected by the first reflecting face 11*a*. FIG. 19 illustrates the distribution angles of the seventh-reflecting-face light 13*g*L reflected by the seventh reflecting face 13*g*. FIG. 20 illustrates the distribution angles of the tenth-reflecting-face light 14*j*L reflected by the tenth reflecting face 14*j*. FIG. 21 illustrates the distribution angles of the second-reflecting-face light 12*b*L reflected by the second reflecting face 12*b*.

As shown in FIG. 18, the first-reflecting-face light 11*a*L has a light distribution angle LX11*a* in the X-axis direction (i.e., the third direction D3) and a light distribution angle LY11*a* in the Y-axis direction. As shown in FIG. 19, the seventh-reflecting-face light 13*g*L has a light distribution angle LX13*g* in the X-axis direction (i.e., the third direction D3) and a light distribution angle LY3*g* in the Y-axis direction. As shown in FIG. 20, the tenth-reflecting-face light 14*j*L has a light distribution angle LX14*j* in the X-axis direction (i.e., the third direction D3) and a light distribution angle LY14*j* in the Y-axis direction. As shown in FIG. 21, the second-reflecting-face light 12*b*L has a light distribution angle LX12*b* in the X-axis direction (i.e., the third direction D3) and a light distribution angle LY12*b* in the Y-axis direction.

For example, the light distribution angle LX11*a* is larger than the light distribution angle LX12*b*. The light distribution angle LX11*a* corresponds to the light distribution angle of the first-reflecting-face light 11*a*L, which is a portion of the first outgoing light 31L reflected by the first reflecting face 11*a*, in the third direction D3. The light distribution angle LX12*b* corresponds to the distribution angle of the second-reflecting-face light 12*b*L, which is a portion of the first outgoing light 31L reflected by the second reflecting face 12*b*, in the third direction D3.

For example, the light distribution angle LY11*a* is larger than the light distribution angle LY12*b*. The light distribution angle LY11*a*, for example, corresponds to the light distribution angle of the first-reflecting-face light 11*a*L in the first plane (the D1-D2 plane). The light distribution angle LY12*b* corresponds to the light distribution angle of the second-reflecting-face light 12*b*L in the first plane.

In one example, the light distribution angle LX13*g* is positioned between the light distribution angle LX11*a* and the light distribution angle LX12*b*. In one example, the light distribution angle LY13*g* is positioned between the light distribution angle LY11*a* and the light distribution angle LY12*b*. In one example, the light distribution angle LX14*j* is positioned between the light distribution angle LX13*g* and the light distribution angle LX12*b*. In one example, the light distribution angle LY14*j* is positioned between the light distribution angle LY13*g* and the light distribution angle LY12*b*.

As shown in FIG. 10, the first reflecting part 11 has a protrusions shape. For example, the first reflecting face 11*a* is protruded with reference to the third reflecting face 11*c*. For example, the first reflecting face 11*a* is protruded with reference to the fourth reflecting face 11*d*. In this manner, the first reflecting part 11 has a protruding shape in at least one of the traveling directions of the first-reflecting-part light 11L (in this example, the direction is along the Z-axis direction, see FIG. 11). With such a shape, the first-reflecting-part light 11L spreads widely. This can increase the light distribution angle of the first-reflecting-part light 11L in the X-axis direction.

As shown in FIG. 7, the second reflecting part 12 has a depressed shape. For example, the second reflecting face 12*b* is depressed with reference to the fifth reflecting face 12*e*. For example, the second reflecting face 12*b* is depressed with reference to the sixth reflecting face 12*f*. In this manner, the second reflecting part 12 has a depressed shape in at least one of the traveling directions of the second-reflecting-part light 12L (in this example, the direction is along the Z-axis direction, see FIG. 11).

As shown in FIG. 9, in this example, the third reflecting part 13 has a depressed shape. For example, the third reflecting part 13 has a depressed shape in at least one of the traveling directions of the third-reflecting-part light 13L. As shown in FIG. 8, in this example, the fourth reflecting part 14 has a depressed shape. For example, the fourth reflecting part 14 has a depressed shape in at least one of the traveling directions of the fourth-reflecting-part light 14L.

As shown in FIG. 4, in a section cut in parallel with the first plane (the D1-D2 plane), the first reflecting face 11*a* has a depressed shape. In a section cut in parallel with the first plane, the second reflecting face 12*b* has a depressed shape. In a section cut in parallel with the first plane, the seventh reflecting face 13*g* has a depressed shape. In a section cut in parallel with the first plane, the tenth reflecting face 14*j* has a depressed shape.

A second plane which includes the third direction D3 is, for example, the X-Z plane. As shown in FIG. 10, in a section cut in parallel with the second plane, the first reflecting face 11*a* has a protruded shape. As shown in FIG. 7, in a section cut in parallel with the second plane, the second reflecting face 12*b* has a depressed shape or is substantially planar.

Figure 5:
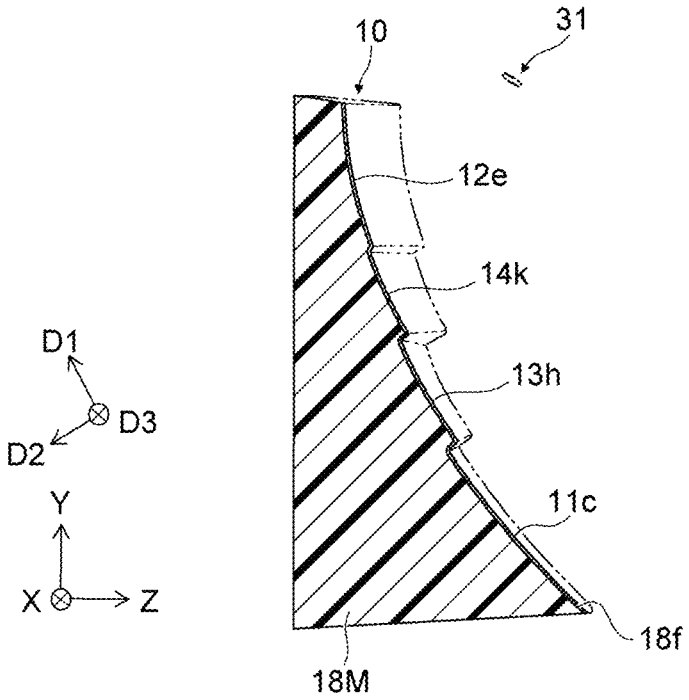
FIG. 5 is a schematic sectional view illustrating a portion of the lighting device according to the first embodiment.
Figure 6:
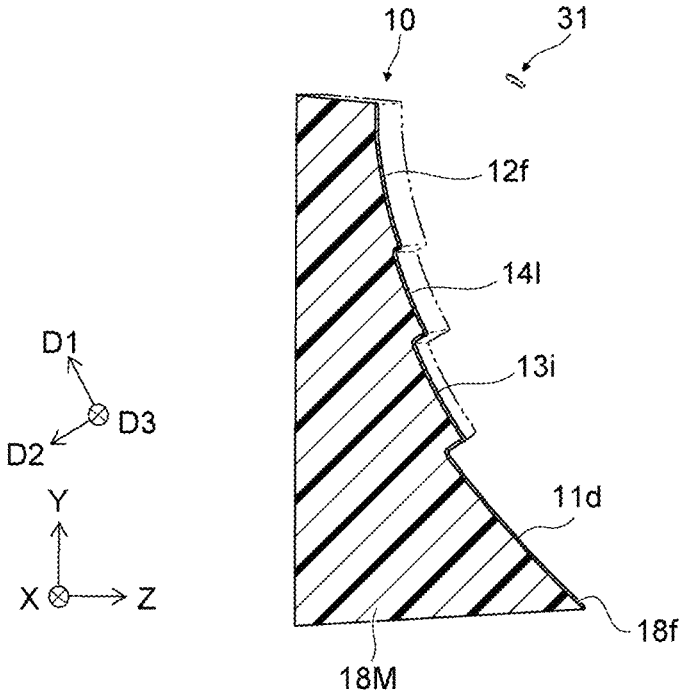
FIG. 6 is a schematic sectional view illustrating a portion of the lighting device according to the first embodiment.

As shown in FIG. 5, in a section cut in parallel with the first plane (the D1-D2 plane), the third reflecting face 11*c* has a depressed shape. As shown in FIG. 6, in a section cut in parallel with the first plane, the fourth reflecting face 11*d* has a depressed shape.

As shown in FIG. 10, in a section cut in parallel with the second plane (the X-Z plane), the third reflecting face 11*c* has a protrusions shape. In a section cut in parallel with the second plane, the fourth reflecting face 11*d* has a protrusions shape. Such a shape can increase the light distribution angle of the first-reflecting-part light 11L reflected by the first reflecting part 11.

As shown in FIG. 4, the first, second, third and fourth reflecting parts 11, 12, 13 and 14 respectively have first, second, third and fourth lengths H1, H2, H3 and H4 along the Y-axis direction. The first to fourth lengths H1 to H4 correspond to the heights. The first length H1 is greater than the second length H2. For example, the third length H3 is smaller than the first length H1, and smaller than the second length H2. For example, the fourth length H4 is smaller than the first length H1, and smaller than the second length H2.

For example, changing the first to fourth lengths H1 to H4 can changes the areas of the first to fourth reflecting parts 11 to 14. Increasing the first length H1 can increase the sizes of the reflecting faces, thereby illuminating a wide region near the first light source part 31. Increasing the second length H2 to some extent can adequately increase the sizes of the reflecting faces, thereby illuminating a region farther from the first light source part 31 with required brightness. The intermediate parts such as the third reflecting part 13 and the fourth reflecting part 14 do not necessarily need large areas because they can receive the effect of the first-reflecting-part light 11L from the first reflecting part 11 or the second-reflecting-part light 12L from the second reflecting part 12.

As previously explained, a plurality of first light emitting parts 81 can be provided. As shown in FIG. 1, in one example, the arrangement direction from one of the first light emitting parts 81 to another one of the first light emitting part 81 is along the third direction D3.

An example of a second light emitting part 82 will be explained below. As shown in FIG. 1, in the case of disposing a plurality of first light emitting parts 81, for example, at least a portion of the second light emitting part 82 can be disposed between the first light emitting parts 81.

Figure 22:
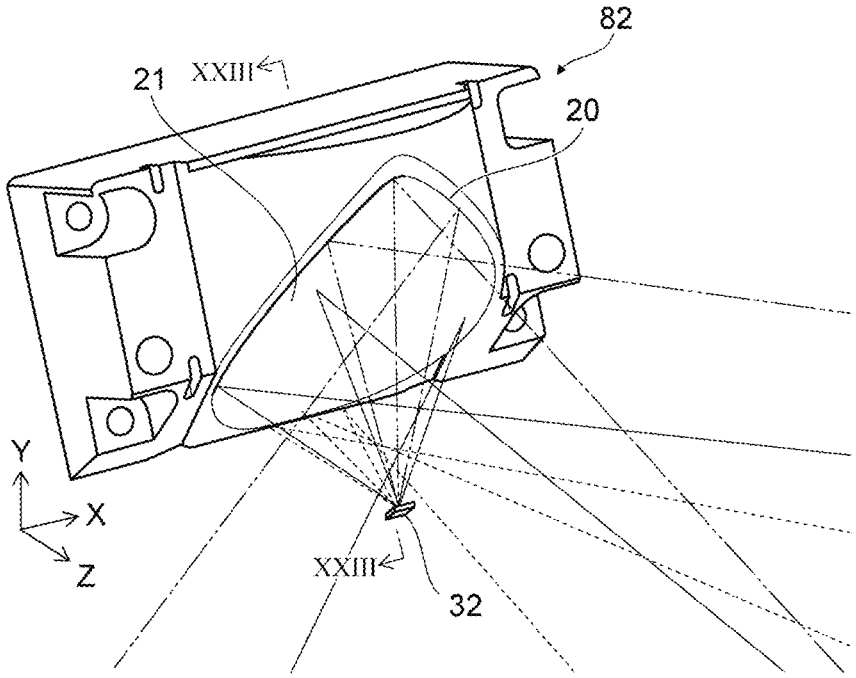
FIG. 22 is a schematic diagram illustrating a portion of the lighting device according to the first embodiment.
Figure 23:
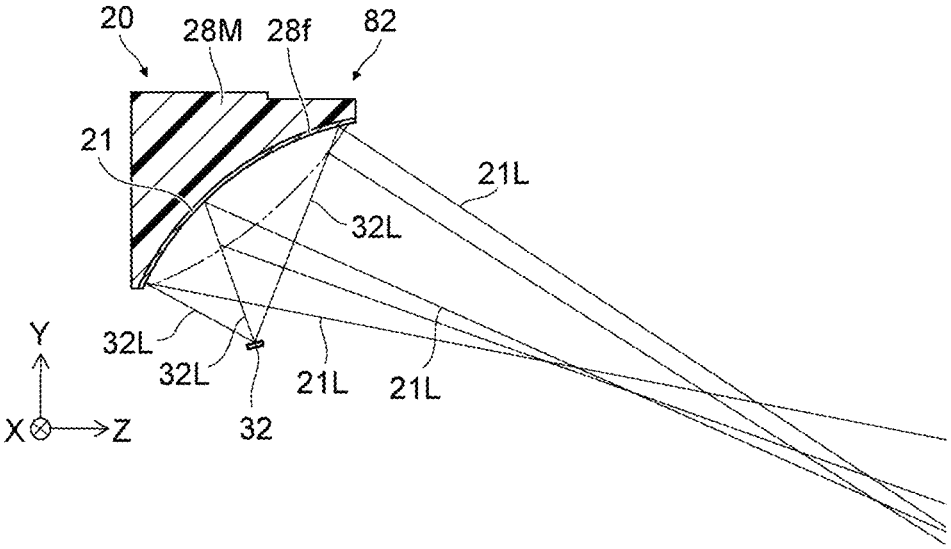
FIG. 23 is a schematic diagram illustrating a portion of the lighting device according to the first embodiment.
Figure 24:
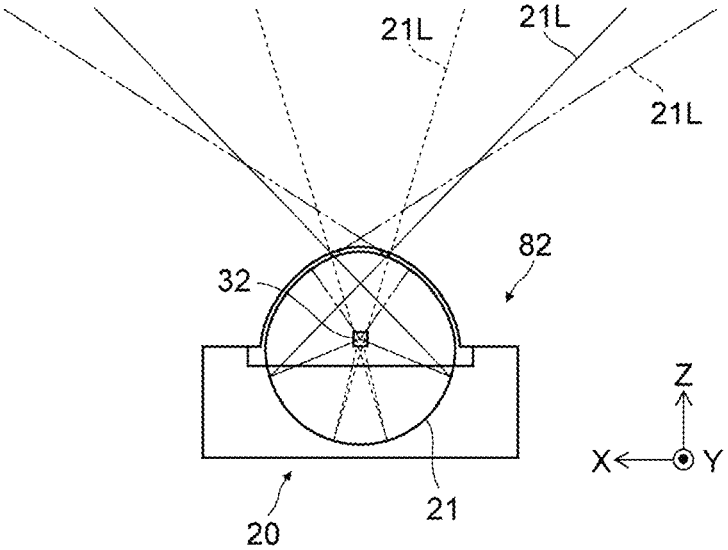
FIG. 24 is a schematic diagram illustrating a portion of the lighting device according to the first embodiment.

FIG. 22 to FIG. 24 are schematic diagrams illustrating a portion of the lighting device according to the first embodiment of the present disclosure.

FIG. 22 to FIG. 24 each illustrate a second light emitting part 82. FIG. 22 is a perspective view. FIG. 23 is a sectional view taken along line XXIII-XXIII in FIG. 22. FIG. 24 is a plan view.

As shown in FIG. 22 to FIG. 24, the second light emitting part 82 includes a second optical part 20 and a second light source part 32. The second optical part 20 has a second-optical-part reflecting face 21. The second-optical-part reflecting face 21 is, for example, a continuously curved surface. The second light source part 32 allows the second outgoing light 32L to be incident on the second-optical-part reflecting face 21.

The second light source part 32 includes, for example, an LED. The light from the LED is incident on the second-optical-part reflecting face 21. The light reflected by the second-optical-part reflecting face 21 becomes the second-optical-part reflected light 21L. The second-optical-part reflected light 21L is incident on the illuminated surface 91. The second-optical-part reflecting face 21 has a continuous depressed shape at least in one of the traveling directions of the second-optical-part reflected light 21L.

As shown in FIG. 23, a second reflecting film 28*f* can be used as the second optical part 20. In this example, the second reflecting film 28*f* is disposed on the surface of the second member 28M. For example, a depression is provided in the second member 28M. The second reflecting film 28*f* is disposed on the surface on which the depression is formed. The second member 28M can contain, for example, a resin, glass, or metal. Examples of the second reflecting film 28*f* includes a metal film such as aluminum film. Light is reflected at the surface of the second reflecting film 28*f*. The second-optical-part reflecting face 21 includes, for example, the second reflecting film 28*f* disposed on the surface of the second member 28M.

As shown in FIG. 23, the second-optical-part reflected light 21L spreads in the Y-Z plane. As shown in FIG. 24, the second-optical-part reflected light 21L spreads in the X-Z plane. The second-optical-part reflected light 21L also spreads in the X-axis direction while advancing along the Z-axis direction.

Figure 25:
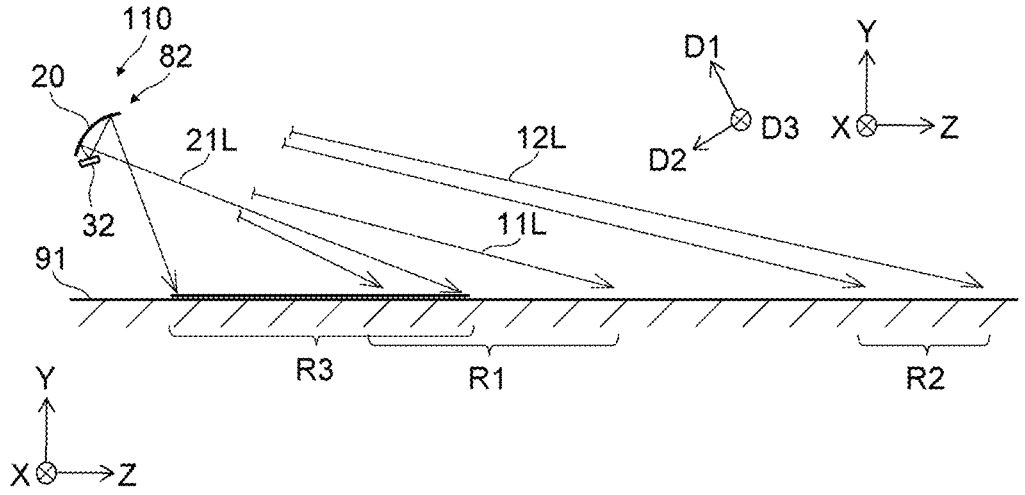
FIG. 25 is a schematic diagram illustrating light in the lighting device according to the first embodiment.

FIG. 25 is a schematic diagram illustrating light in a lighting device according to the first embodiment of the present disclosure.

FIG. 25 illustrates the second-optical-part reflected light 21L outgoing from the second light emitting part 82. FIG. 25 illustrates the first illuminated region R1 on which the first-reflecting-part light 11L is incident, and the second illuminated region R2 on which the second-reflecting-part light 12L is incident. In FIG. 25, the position of the first light emitting part 81 is substantially the same as the position of the second light emitting part 82. In order for the drawing to be easily understood, the first light emitting part 81 is omitted in FIG. 25.

As shown in FIG. 25, the lighting device 110 illuminates the illuminated surface 91 from one side of the illuminated surface 91. The light outgoing from the first light emitting part 81 (e.g., the first-reflecting-part light 11L) is incident on the first illuminated region R1 of the illuminated surface 91. In other words, the first light emitting part 81 illuminates the first illuminated region R1. The light outgoing from the second light emitting part 82 (e.g., the second-optical-part reflected light 21L) is incident on a third illuminated region R3 of the illuminated surface 91. In other words, the second light emitting part 82 illuminates the third illuminated region R3. At least one portion of the third illuminated region R3 is closer than the first illuminated region R1 with reference to the first light emitting part 81 or the second light emitting part 82. The distance between at least one portion of the third illuminated region R3 and the second light emitting part 82 is smaller than the distance between the first illuminated region R1 and the first light emitting part 81. For example, the third illuminated region R3, the first illuminated region R1, and the second illuminated region R2 are formed in that order of being the closest to the furthest from the lighting device 110.

The reflecting parts (e.g., the first reflecting part 11, the second reflecting part 12, and the like) included in the first light emitting part 81 reflect light to allow the reflect light to be incident on the first illuminated region R1. The second-optical-part reflecting face 21 included in the second light emitting part 82 reflects light to allow the reflect light to be incident on the third illuminated region R3. Combination of the first light emitting part 81 and the second light emitting part 82, a large area can be illuminated with uniform brightness.

The first reflecting part 11 is farther from a light source than the second reflecting part 12 is. For example, the first-reflecting-part light 11L reflected by the first reflecting part 11 has a larger light distribution angle and a larger depression angle than those of the second-reflecting-part light 12L described later. The first-reflecting-part light 11L reflected by the first reflecting part 11 illuminates the first illuminated region R1 located in the middle. The second-reflecting-part light 12L reflected by the second reflecting part 12 has a smaller light distribution angle and a smaller depression angle than those of the first-reflecting-part light 11L. The second-reflecting-part light 12L reflected by the second-reflecting-part 12 illuminates the second illuminated region R2 located further away. The second-optical-part reflected light 21L reflected by the second-optical-part reflecting face 21 of the second light emitting part 82 illuminates the third illuminated region R3 located closer to the second light emitting part 82. For example, the brightness unevenness remaining in the light from the first light emitting part 81 is compensated for by the light from the second light emitting part 82, thereby achieving uniform brightness across a large area.

Figure 26:
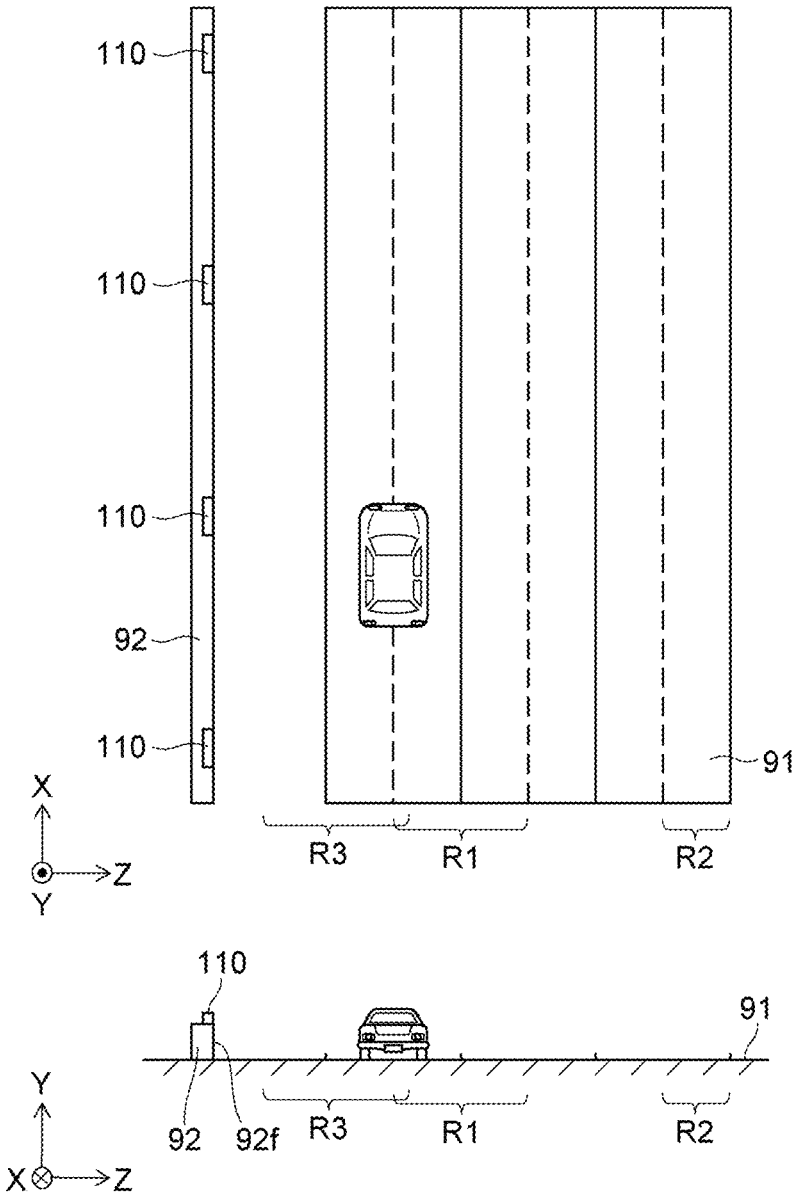
FIG. 26 is a schematic diagram illustrating the lighting devices according to the first embodiment in use.

FIG. 26 is a schematic diagram illustrating the lighting devices according to the first embodiment in use.

As shown in FIG. 26, the illuminated surface 91 is a road surface. A sidewall 92 meeting the illuminated surface 91 is provided. The lighting devices 110 according to the embodiment are disposed, for example, on the sidewall 92. The lighting devices 110 are disposed, for example, on the lateral face 92*f* that meets the illuminated surface 91 to illuminate the road from the side of the road. Accordingly, uniform brightness in the Z-axis direction may be achieved by one lighting device 110.

As shown in FIG. 26, a plurality of lighting devices 110 are arranged along the X-axis direction. In the illuminated surface 91, a portion of the light outgoing from one of the lighting devices 110 overlaps with the light outgoing from another one of the lighting devices 110. The brightness in the X-axis direction can be made uniform by the plurality of lighting devices 110.

Second Embodiment

Figure 27:
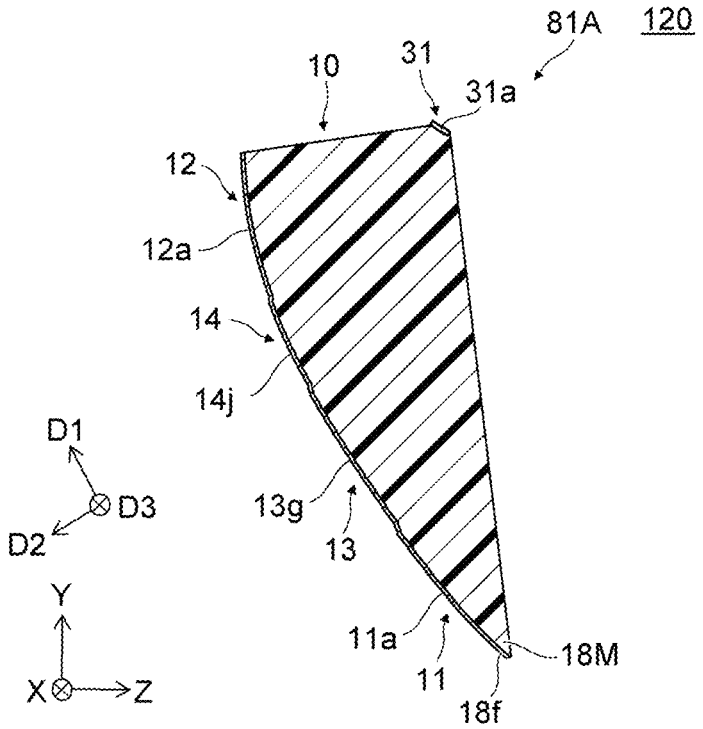
FIG. 27 is a schematic sectional view illustrating a portion of a lighting device according to a second embodiment.

FIG. 27 is a schematic sectional view illustrating a portion of a lighting device according to a second embodiment of the present disclosure.

FIG. 27 illustrates a first light emitting part 81A in a lighting device 120 according to the second embodiment. FIG. 27 is a cross section corresponding to the cross section shown in FIG. 4.

As shown in FIG. 27, the first light emitting part 81A also includes a first optical part 10 and a first light source part 31. The first optical part 10 includes a first member 18M and a first reflecting film 18*f*. The light outgoing from the first light source part 31 transmits through the first member 18M before being incident on the first reflecting film 18*f*. The light reflected by the first reflecting film 18*f* is incident on the illuminated surface 91. The first optical part 10 in this case also includes a plurality of reflecting parts, such as the first reflecting part 11, the second reflecting part 12, and the like. The first reflecting film 18*f* functions as multiple reflecting parts.

As in the case of the first light emitting part 81A in the lighting device 120, the first optical part 10 can be of a back-face reflection type. For the reflecting parts in the second embodiment, the reflecting parts configured as explained in relation to the first embodiment can be applied. The lighting device provided according to the second embodiment can also exhibit an improved brightness uniformity in the illuminated surface.

Third Embodiment

Figure 28:
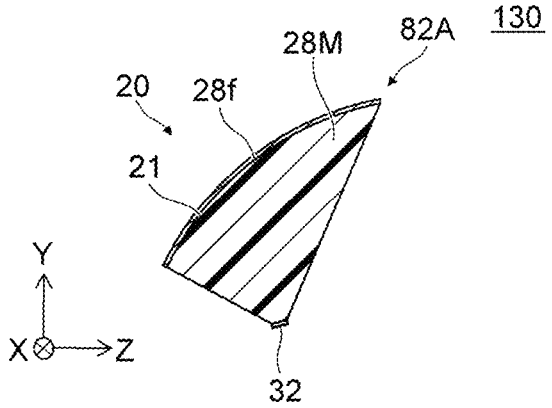
FIG. 28 is a schematic sectional view illustrating a portion of a lighting device according to a third embodiment.

FIG. 28 is a schematic sectional view illustrating a portion of a lighting device according to a third embodiment of the present disclosure.

FIG. 28 illustrates a second light emitting part 82A in a lighting device 130 according to the third embodiment. FIG. 28 illustrates a cross section corresponding to the cross section shown in FIG. 23.

As shown in FIG. 28, the second lighting part 82A also includes a second optical part 20 and a second light source part 32. The second optical part 20 includes a second member 28M and a second reflecting film 28*f*. The light outgoing from the second light source part 32 transmits through the second member 28M before being incident on the second reflecting film 28*f*. The light reflected by the second reflecting film 28*f* is incident on the illuminated surface 91. The second optical part 20 in this case also has a second-optical-part reflecting face 21. The second reflecting film 28*f* functions as the second-optical-part reflecting face 21.

As in the case of the second optical part 82A in the lighting device 130, the second optical part 20 can be of a back-face reflection type. For the second-optical-part reflecting face 21 in the third embodiment, the second-optical-part reflecting face 21 configured as explained in relation to the first embodiment can be applied. The lighting device provided according to the third embodiment can also exhibit an improved brightness uniformity in the illuminated surface.

The first light emitting part 81A explained in relation to the second embodiment and the second light emitting part 82A explained in relation to the third embodiment can be combined.

Another example of the usage of a lighting device according to an embodiment will be explained below. In the example below, alighting device 110 is used as the lighting device according to the embodiment.

Figure 29:
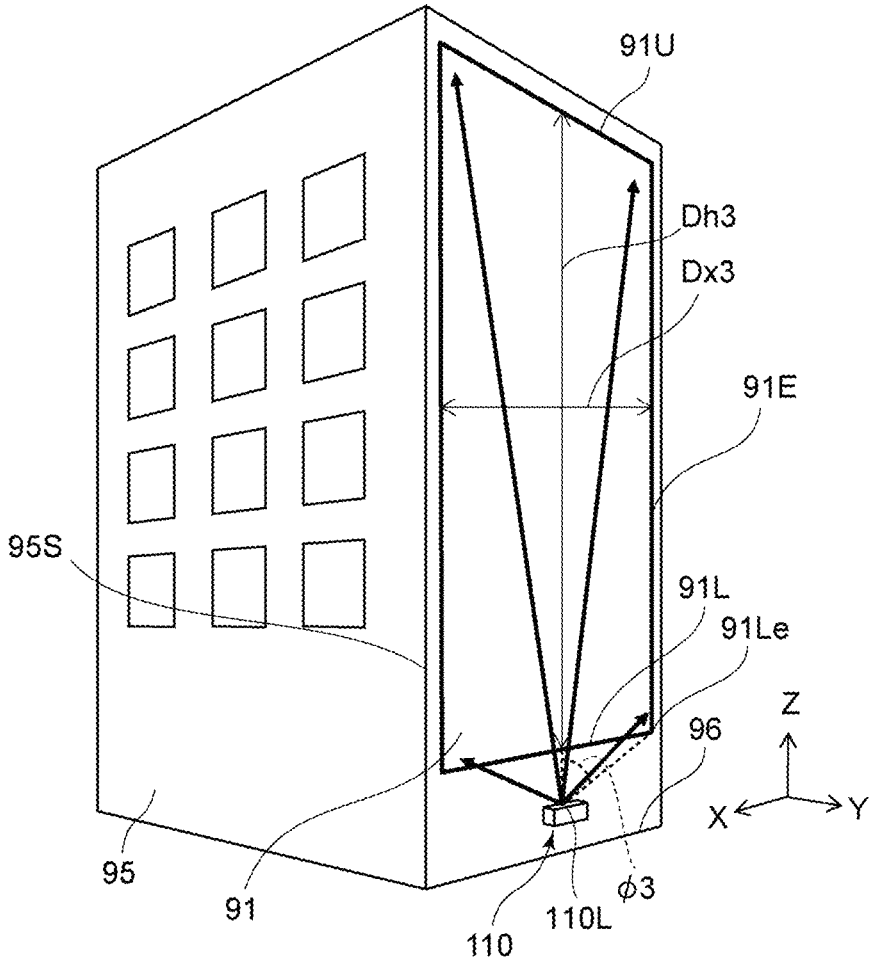
FIG. 29 is a schematic diagram illustrating a lighting device according to one embodiment in use.

FIG. 29 is a schematic diagram of the lighting device according to the embodiment in use.

As shown in FIG. 29, any of the lighting devices according to the first to third embodiments can illuminate a building 95. The illuminated surface 91 is, for example, a wall face 95S of the building 95. The light outgoing from the lighting device 110 is incident on the wall face 95S, achieving a substantially uniform brightness at least in a portion of the wall face 95S, for example, in the illuminated region 91E. The illuminated region 91E corresponds to the "effective illuminated region". As shown in FIG. 29, the lighting device 110 can be disposed at a distance or far from the ground 96.

The height of the building 95 corresponds to the Z axis direction. The left/right direction of the wall face 95S corresponds to the X axis direction. The direction perpendicular to the wall face 95S corresponds to the Y axis direction. The length of the illuminated region 91E along the Z axis direction is denoted as length Dh3 (i.e., height). The length of the illuminated region 91E along the X axis direction is denoted as length Dx3 (i.e., left/right width). As shown in FIG. 29, the angle formed by the line extending in the Z axis direction from the projected position of the emission part 110L on the illuminated surface 91 (i.e., wall face 95S) in the Y axis direction and the line extending from the projected position of the emission part 110L on the illuminated surface 91 (i.e., wall face 95S) in the Y axis direction to one end 91Le of the lower edge 91L of the illuminated region 91 is denoted as angle $\phi$3.

Examples of simulated characteristics of the lighting device 110 will be explained below.

Figure 30:
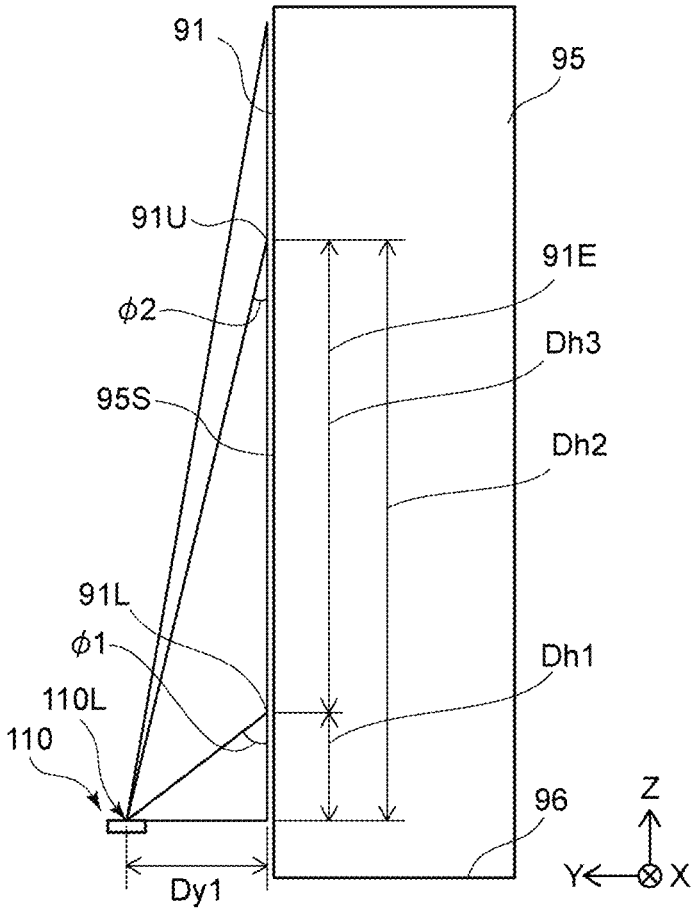
FIG. 30 is a schematic view illustrating a lateral face of the lighting device according to the embodiment in use.

FIG. 30 is a schematic lateral face view illustrating the lighting device according to the embodiment in use.

As shown in FIG. 30, the distance between the emission part 110L of the lighting device 110 and the illuminated surface 91 (i.e., wall face 95S) along the Y axis direction is denoted as a distance Dy1. The distance Dy1 corresponds to the distance to the emission part 110L from the wall face 95S. The distance between the lower edge of the illuminated region 91E and the emission part 110L along the Z axis direction is denoted as a length Dh1. The distance between the upper edge of the illuminated region 91E and the emission part 110L along the Z axis direction is denoted as a length Dh2. The sum of the length Dh1 and the length Dh3 corresponds to the length Dh2. As shown in FIG. 30, in the Y-Z plane passing the emission part 110L, the angle formed by the illuminated surface 91 (wall face 95S) and the direction, which connects the emission part 110L and the lower edge 91L of the illuminated region 91E, is denoted as angle $\phi$1. In the Y-Z plane passing the emission part 110L, the angle formed by the illuminated surface 91 (i.e., wall face 95S) and the direction, which connects the emission part 110L and the upper edge 91U of the illuminated region 91E, is denoted as angle $\phi$2.

FIG. 31 is a table showing the characteristics of the lighting device according to the embodiment.

FIG. 31 shows examples of simulation results of the illuminated region 91E (the "effective illuminated region" where a substantially uniform brightness can be achieved) when the distance Dy1 (i.e., distance from the wall face 95S to the emission part 110L) is changed. In this example, the range in which one half of the peak illuminance in the illuminated region 91E can be achieved constitutes the outer boundary of the illuminated region 91E. In other words, the illuminance at the edges of the illuminated region 91E in the height direction thereof referred to as the length Dh3 (i.e., height), and the edges of the illuminated region 91E in the left/right direction thereof referred to as the length Dx3 (i.e., left/right width), is one half of the peak illuminance. The illuminance within the illuminated region 91E is substantially uniform, and the illuminance outside of the illuminated region 91E is nonuniform. In practice, the range in which one half of the peak illuminance in the illuminated region 91E is substantially achieved may be considered as the outer boundary of the illuminated region 91E.

In this example, the angle $\phi$3 (see FIG. 29) is 59.5 degrees. The angle $\phi$1 (see FIG. 30) is 32.1 degrees. The angle $\phi$2 (FIG. 30) is 4.5 degrees.

FIG. 31 also shows average illuminance AvIL and distance coefficient CD. Average illuminance AvIL is the average illuminance in the illuminated region 91E. Distance coefficient CD is a ratio of a distance Dy1 when the distance Dy1 of 1.0975 m is 1.

As shown in FIG. 31, as the distance Dy1 increases, the lengths Dh1, Dh2, Dh3, and Dx3 increase. In other words, as the distance Dy1 increases, the size of the illuminated region 91E both in the height direction and the left/right direction increases. On the other hand, as the distance Dy1 increases, the average illuminance AvIL decreases.

Figure 32:
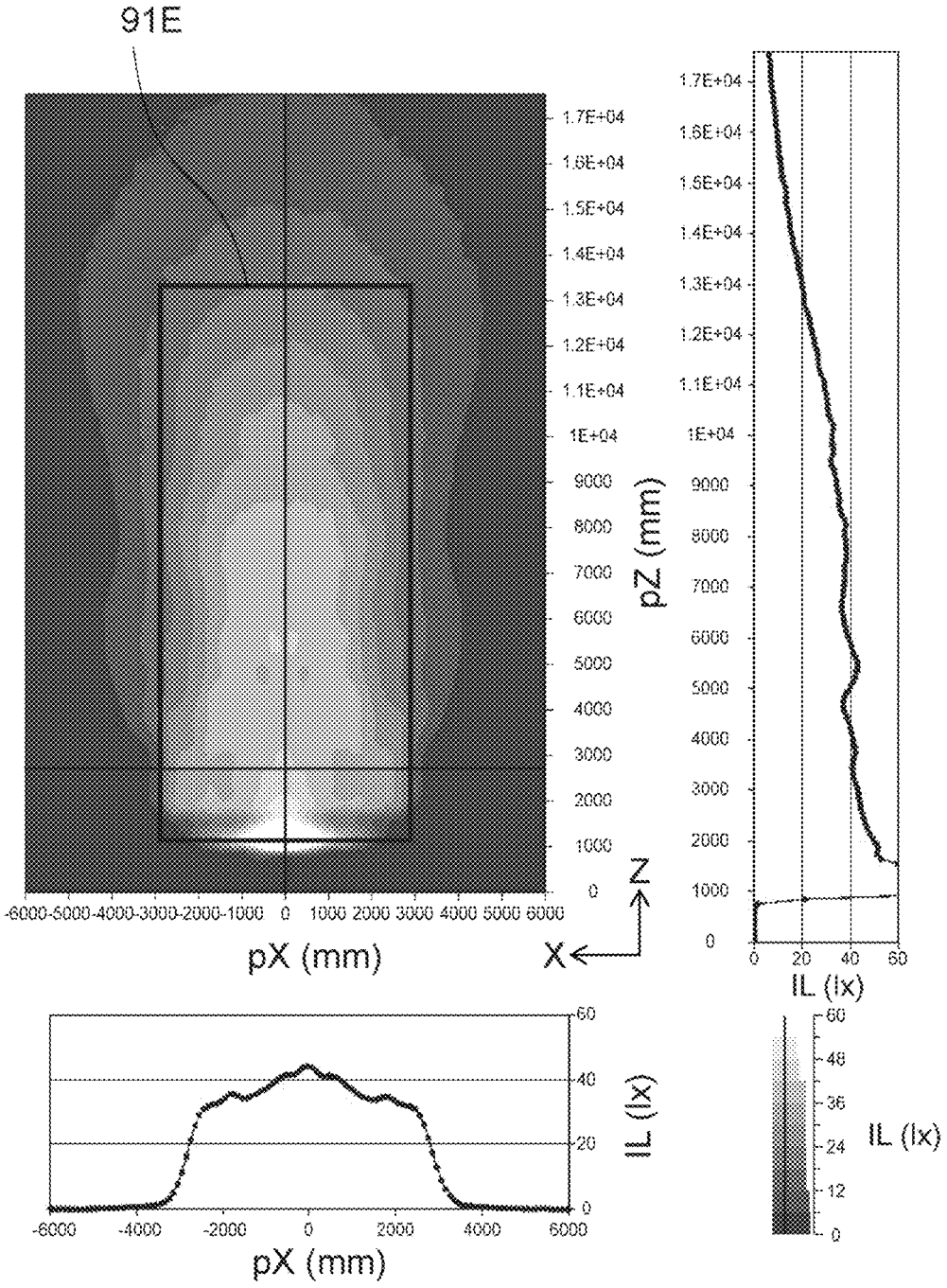
FIG. 32 includes a schematic diagram and graphs showing the characteristics of a lighting device according to one embodiment.
Figure 33:
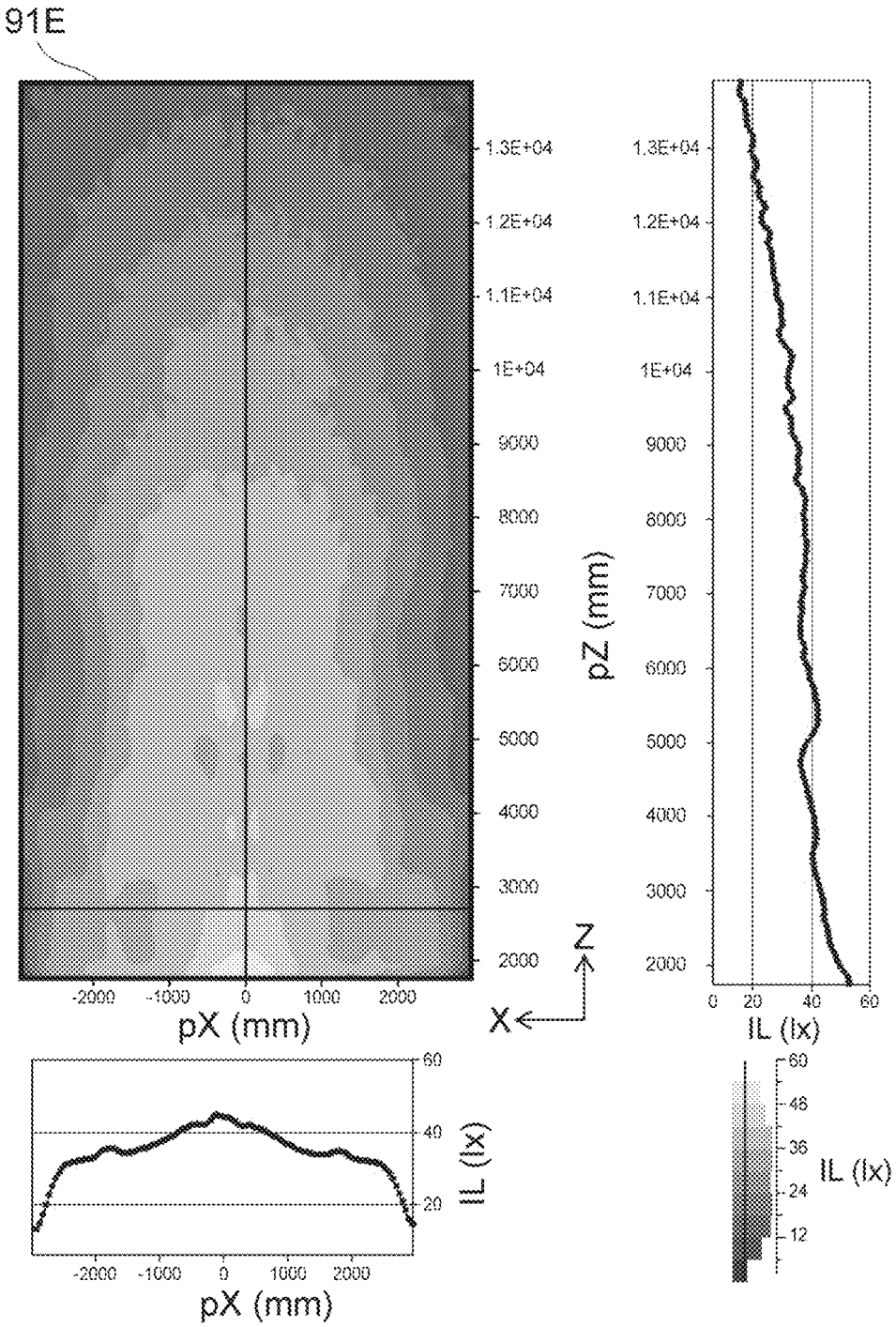
FIG. 33 includes a schematic diagram and graphs showing the characteristics of a lighting device according to one embodiment.

FIG. 32 and FIG. 33 are schematic diagrams showing the characteristics of the lighting device according to the embodiment.

In FIG. 32, illuminance IL in the X-Z plane is shown. Positions pX in the X axis direction and positions in the Z axis direction pZ is defined by using the position of the emission part 110L as a reference. The diagrams in FIG. 33 represent enlarged portions of those shown in FIG. 32. As shown in FIG. 32 and FIG. 33, the illuminance IL is substantially symmetrical at positions pX on the left and right sides in the X axis direction. The illuminance IL declines as the positions pZ is numbered with a greater numeral along the Z axis direction. As shown in FIG. 32 and FIG. 33, the illuminated region 91E with substantially uniform illuminance is substantially rectangular in shape.

When the distance Dy1 changes, the size of the illuminated region 91E changes because the illuminated regions 91E shown in both FIG. 32 and FIG. 33 are correlated.

In one example, when the distance Dy1 is 1.75 m, the length Dh1 is 2.79 m, the length Dh2 is 22.2 m, and the length Dh3 is 19.4 m. In this case, the average illuminance AvIL in the illuminated region 91E is 11.02 lx.

The simulation result examples described above are also applicable in the case in which the illuminated surface 91 is a road surface. In this case, the distance Dy1 corresponds to the distance (i.e., height) from the road surface to the emission part 110L.

As shown in FIG. 1 and FIG. 2, the first light emitting part 81 includes a first light reflector 10 (also referred to herein as the optical part) and a first light source part 31. The first light source part 31 includes, for example, alight emitting diode (LED).

As shown in FIG. 3, the first light source part 31 can include a plurality of light sources, such as a first light source 31*a*, a second light source 31*b*, a third light source 31*c* and the like. The first light source 31*a*, the second light source 31*b*, and the third light source 31*c* each includes an LED, for example. In this example, the first light source 31*a* is located between the second light source 31*b* and the third light source 31*c*. Light is output from each light source. The light source is positioned laterally adjacent to the light reflector 10.

The first light source part 31 can be located at the central position of the first light source part 31. For example, the position of the first light source part 31 can be substantially the central position of the first light source 31*a*.

As shown in FIG. 2, the first light reflector 10 includes multiple light reflective faces (also referred to herein as light reflecting parts) arranged in an array in an adjacent or non-adjacent manner. The array is an m by n array, where n is an integer with a value greater than one, and m is an integer with a value greater than one. The first light reflector 10 is shown with a three by four array of light reflective faces, though in some implementations the light reflector has more or less reflective faces in the array. The first light reflector 10 includes a first row of light reflecting faces 11 (also referred to herein as a first reflecting part) and a second row of light reflecting faces 12 (also referred to herein as a second reflecting part). As such, the first light reflector 10 includes a plurality of light reflecting faces.

In this example, the first light reflector 10 further includes a third row of light reflecting faces 13 and a fourth row of light reflecting faces 14. At least one portion of the third row of light reflecting faces 13 is located between the first row of light reflecting faces 11 and the second row of light reflecting faces 12. At least one portion of the fourth row of light reflecting faces 14 is located between the third row of light reflecting faces and the second row of light reflecting faces 12. The number of rows of reflecting faces provided in the first optical part 10 can be appropriately determined.

As shown in FIG. 2, the first row of light reflecting faces 11 includes a first reflecting face 11*a*, and the second row of light reflecting faces 12 includes a second reflecting face 12*b*. In this example, the first row of light reflecting faces 11 includes a third reflecting face 11*c* and a fourth reflecting face 11*d*. For example, at least one portion of the first reflecting face 11*a* is located between the third reflecting face 11*c* and the fourth reflecting face 11*d*. The second row of light reflecting faces 12 includes a fifth reflecting face 12*e* and a sixth reflecting face 12*f*. For example, at least one portion of the second reflecting face 12*b* is located between the fifth reflecting face 12*e* and the sixth reflecting face 12*f*. The number of reflecting faces provided in each of the first row of light reflecting faces 11 and the second row of light reflecting faces 12 can be appropriately determined.

The light reflective faces are positioned in an optical path of the light source 31. The first row of light reflecting faces 11 reflects light from the light source at a first light distribution angle. The second row of light reflecting faces 12 reflects light from the light source 31 at a second light distribution angle. Though the light distribution varies depending on the orientation of the light reflecting faces, the second light distribution angle of light reflected from a center of the second row of light reflecting faces 12 is greater than the first light distribution angle of light reflected from a center of the second row of light reflecting faces 11. The relationship between the light distribution angles of the light reflecting faces will be described in greater detail below.

Practically, the first row of light reflecting faces 11 can be considered to be located at the central position of the first row of light reflecting faces 11. For example, the first row of light reflecting faces 11 can substantially be located at the center 11*ac* of the first reflecting face 11*a* (see FIG. 4).

Practically, the second row of light reflecting faces 12 can be considered to be located at the central position of the second row of light reflecting faces 12. For example, the position of the second row of light reflecting faces 12 can substantially be the center 12*bc* of the second reflecting face 12*b* (see FIG. 4).

As shown in FIG. 2 and FIG. 4, the direction from the first row of light reflecting faces 11 to the second row of light reflecting faces 12 is assumed as a first direction D1. As shown in FIG. 4, the direction from the center 11*ac* of the first reflecting face 11*a* to the center 12*bc* of the second reflecting face 12*b* corresponds to the first direction D1.

As shown in FIG. 2 and FIG. 4, the direction from the first light source part 31 to the second row of light reflecting faces 12 is assumed as a second direction D2. The first direction D1 intersects with the second direction D2. For example, the second direction D2 corresponds to the direction from the center of the first light source 31*a* of the first light source part 31 to the center 12*bc* of the second reflecting face 12*b*.

As shown in FIG. 4, the direction Dz1 from the first light source part 31 to the first row of light reflecting faces 11 is along a first plane which includes the first direction D1 (i.e., the D1-D2 plane) and the second direction D2. The direction Dz1 intersects with the second direction D2. In other words, using the position of the first light source part 31 as a reference, the direction to the second row of light reflecting faces 12 and the direction to the first row of light reflecting faces 11 are different from one another. The direction Dz1 from the first light source part 31 to the first row of light reflecting faces 11 corresponds to the direction from the central position of the first light source part 31 to the central position of the first row of light reflecting faces 11.

FIG. 10 corresponds to a cross section taken along the Z-X plane which includes the center of the first row of light reflecting faces 11 in the Y-axis direction. The first reflecting face 11*a* in the third direction D3 can practically be at the center 11*ac* of the first reflecting face 11*a* in the third direction D3 (see FIG. 3 and FIG. 10). The third reflecting face 11*c* in the third direction D3 can practically be at the center 11*cc* of the third reflecting face 11*c* in the third direction D3 (see FIG. 3 and FIG. 10). The position of the fourth reflecting face 11*d* in the third direction D3 can practically be at the center 11*dc* of the fourth reflecting face 11*d* in the third direction D3 (see FIG. 3 and FIG. 10).

FIG. 7 corresponds to a cross section taken along the Z-X plane that includes the center of the second row of light reflecting faces 12 in the Y-axis direction. The position of the second reflecting face 12*b* in the third direction D3 can practically be at the center 12*bc* of the second reflecting face 12*b* in the third direction D3 (see FIG. 3 and FIG. 7). The position of the fifth reflecting face 12*e* in the third direction D3 can practically be at the center 12*ec* of the fifth reflecting face 12*e* in the third direction D3 (see FIG. 3 and FIG. 7). The position of the sixth reflecting face 12*f* in the third direction D3 can practically be at the center 12*fc* of the sixth reflecting face 12*f* in the third direction D3 (see FIG. 3 and FIG. 7).

As shown in FIG. 3, the third row of light reflecting faces 13 is located, for example, between the first row of light reflecting faces 11 and the second row of light reflecting faces 12. The third row of light reflecting faces 13 includes, for example, a seventh reflecting face 13*g*, an eighth reflecting face 13*h*, and a ninth reflecting face 13*i*. For example, at least one portion of the seventh reflecting face 13*g* is located between the first reflecting face 11*a* and the second reflecting face 12*b*. At least one portion of the eighth reflecting face 13*h* is located between the third reflecting face 11*c* and the fifth reflecting face 12*e*. At least one portion of the ninth reflecting face 13*i* is located between the fourth reflecting face 11*d* and the sixth reflecting face 12*f*. The position of the seventh reflecting face 13*g* in the third direction D3 is between the position of the eighth reflecting face 13*h* in the third direction D3 and the position of the ninth reflecting face 13*i* in the third direction D3. The number of reflecting faces provided in the third row of light reflecting faces 13 can be appropriately determined.

FIG. 9 corresponds to across section taken along the Z-X plane which includes the center of the third row of light reflecting faces 13 in the Y-axis direction. The position of the seventh reflecting face 13*g* in the third direction D3 can practically be at the center 13*gc* of the seventh reflecting face 13*g* in the third direction D3 (see FIG. 9). The position of the eighth reflecting face 13*h* in the third direction D3 can practically be at the center 13*hc* of the eighth reflecting face 13*h* in the third direction D3 (see FIG. 9). The position of the ninth reflecting face 13*i* in the third direction D3 can practically be at the center 31*c* of the ninth reflecting face 13*i* in the third direction D3 (see FIG. 9).

As shown in FIG. 3, the fourth row of light reflecting faces 14 is located, for example, between the third row of light reflecting faces 13 and the second row of light reflecting faces 12. The fourth row of light reflecting faces 14 includes, for example, a tenth reflecting face 14*j*, an eleventh reflecting face 14*k*, and a twelfth reflecting face 14*l*. For example, at least one portion of the tenth reflecting face 14*j* is located between the seventh reflecting face 13*g* and the second reflecting face 12*b*. At least one portion of the eleventh reflecting face 14*k* is located between the eighth reflecting face 13*h* and the fifth reflecting face 12*e*. At least one portion of the twelfth reflecting face 14*l* is located between the ninth reflecting face 13*i* and the sixth reflecting face 12*f*. The position of the tenth reflecting face 14*j* in the third direction D3 is between the position of the eleventh reflecting face 14*k* in the third direction D3 and the position of the twelfth reflecting face 14*l* in the third direction D3. The number of reflecting faces provided in the fourth row of light reflecting faces 14 can be appropriately determined.

FIG. 8 corresponds to a cross section taken along the Z-X plane which includes the center of the fourth row of light reflecting faces 14 in the Y-axis direction. The position of the tenth reflecting face 14*j* in the third direction D3 can practically be at the center 14*jc* of the tenth reflecting face 14*j* in the third direction D3 (see FIG. 8). The position of the eleventh reflecting face 14*k* in the third direction D3 can practically be at the center 14*kc* of the eleventh reflecting face 14*k* in the third direction D3 (see FIG. 8). The position of the twelfth reflecting face 14*l* in the third direction D3 can practically be at the center 141*c* of the twelfth reflecting face 14*l* in the third direction D3 (see FIG. 8).

The first to fourth rows of light reflecting faces 11 to 14 are, for example, discontinuous with one another. For example, multiple reflecting faces included in each of the first to fourth rows of light reflecting faces 11 to 14 are discontinuous with one another. For example, one or more steps are present between multiple reflecting faces included in each of the first to fourth rows of light reflecting faces 11 to 14. For example, one or more steps are present between the first to fourth rows of light reflecting faces 11 to 14.

As shown in FIG. 4 to FIG. 10, for example, a first reflecting film 18*f* can be used as the first optical part 10. In this example, the first reflecting film 18*f* is disposed on the surface of the first member 18M. For example, the first member 18M is provided with protrusions and depressions. The first reflecting film 18*f* is disposed on the surface having the protrusions and protrusions. The first member 18M can include, for example, a resin, glass, or metal. Resins include, for example, polybutylene terephthalate (PBT). Using a resin can simplify processing. The first reflecting film 18*f* includes a metal film such as an aluminum film, for example. Light is reflected by the surface of the first reflecting film 18*f*. For example, the first to fourth rows of light reflecting faces 11 to 14 include the first reflecting film 18*f* disposed on the surface of the first member 18M. For example, the first to fourth rows of light rows of light reflecting faces 11 to 14 correspond to the surface of the first reflecting film 18*f*. For example, the reflecting faces correspond to the surface of the first reflecting film 18*f*.

The light reflective faces of the light reflectors are positioned in an optical path of the light source 31. The light outgoing from the first light source part 31 is incident on the multiple reflecting parts included in the first optical part 10. The reflecting parts reflect the light outgoing from the first light emitting part 81. The reflected light is incident on the illuminated surface, for example, a road.

The light outgoing from the first light source part 31 is incident on multiple reflecting faces. The reflecting faces reflect the light outgoing from the first light emitting part 81. The reflected light is incident on the illuminated surface, for example, a road.

As shown in FIG. 4, the distance d between the first row of light reflecting faces 11 and the first light source part 31 is larger than the distance d2 between the second row of light reflecting faces 12 and the first light source part 31. The distance d1, for example, corresponds to the distance between the center 11*ac* of the first reflecting face 11*a* and the center of the first light source part 31. The distance d2, for example, corresponds to the distance between the center 12*bc* of the second reflecting face 12*b* and the center of the light source part 31.

FIG. 11 is a schematic plan view illustrating the reflection of light in the lighting device according to the first embodiment.

FIG. 12 is a schematic sectional view illustrating the reflection of light in the lighting device according to the first embodiment.

FIG. 13 is a schematic diagram illustrating light in the lighting device according to the first embodiment.

As shown in FIG. 4 and FIG. 11, a portion of the first outgoing light 31L from the first light source part 31 is reflected by the first row of light reflecting faces 11, and then becomes the first-reflecting-part light 11L. A portion of the first outgoing light 31L from the first light source part 31 is reflected by the second row of light reflecting faces 12, and then becomes the second-reflecting-part light 12L.

As shown in FIG. 4 and FIG. 13, for example, the first row of light reflecting faces 11 has a first focal point 11*f* in the first plane (the D1-D2 plane). The distance from the first row of light reflecting faces 11 to the first focal point 11*f* corresponds to the first focal point distance f1 (see FIG. 13). As shown in FIG. 13, the first-reflecting-part light 11L is incident on the illuminated surface 91 after advancing through the focal point 11*f*.

On the other hand, the second row of light reflecting faces 12 has no focal point in the first plane (the D1-D2 plane). Alternatively, in the case in which the second row of light reflecting faces 12 has a focal point in the first plane (the D1-D2 plane), the focal point distance of the second row of light reflecting faces 12 is larger than the first focal point distance f1.

As shown in FIG. 13, the first light emitting part 81 allows light (i.e., the first-reflecting-part light 11L, the second-reflecting-part light 12L, and the like) to be incident on the illuminated surface 91 from a side of the illuminated surface 91. The first-reflecting-part light 11L is incident on a first illuminated region R1 of the illuminated surface 91. The second-reflecting-part light 12L is incident on a second illuminated region R2 of the illuminated surface 91. The distance between at least one portion of the first illuminated region R1 and the first light emitting part 81 is smaller than the distance between the second illuminated region R2 and the first light emitting part 81.

The distance between the first illuminated region R1 and the first light emitting part 81 is smaller than the distance between the second illuminated region R2 and the first light emitting part 81. The first-reflecting-part light 11L is incident on the first illuminated region R1 in the illuminated surface 91. The second-reflecting-part light 12L is incident on the second illuminated region R2 in the illuminated surface 91.

In this embodiment, the first row of light reflecting faces 11 is located farther from the first light source part 31 than the second row of light reflecting faces 12 is. The second row of light reflecting faces 12 is located closer to the first light source part 31 than the first row of light reflecting faces 11 is. The light distribution angle DA1 of the first-reflecting-part light 11L reflected by the first row of light reflecting faces 11 is larger than the light distribution angle DA2 of the second-reflecting-part light 12L reflected by the second row of light reflecting faces 12. This can further improve the brightness uniformity in the illuminated surface 91.

The first-reflecting-part light 11L reflected by the first row of light reflecting faces 11 is incident on the first illuminated region R1 that is closer to the first light source part 31, and the second-reflecting-part light 12L reflected by the second row of light reflecting faces 12 is incident on the second illuminated region R2 in the illuminated surface 91. At this time, by setting the relationship between the light distribution angles described above, the brightness of the illuminated regions can be brought closer between closer region to and farther region from the first light source part 31. This can improve the brightness uniformity in the illuminated surface 91.

The embodiments can include following configurations:

(Configuration 1) A lighting device comprising:

at least one light reflector comprising a plurality of light reflective faces each adjacently arranged in an n by m array, n having an integer value greater than 1 and m having an integer value greater than 1; and a light source positioned laterally adjacent to the at least one light reflector at a first distance from a center of a first row of the n by m array and a second distance from a center of a second row of the n by m array, the first distance being less than the second distance, wherein each of the plurality of light reflective faces are oriented in an optical path of the light source, the first row comprising light reflective faces arranged to reflect light from the light source at a first light distribution angle, the second row comprising light reflective faces arranged to reflect light from the light source at a second light distribution angle, and the first light distribution angle is greater than the second light distribution angle.

(Configuration 2) The lighting device of Configuration 1, wherein the first light distribution angle is measured in a first plane comprising a first vector from the center of the first row to a center of the light source and a second vector from the center of the first row to the center of the second row, and the second light distribution angle is measured in a second plane comprising a third vector from a center of the second row to the center of the light source and a fourth vector from the center of the second row to the center of the first row.

(Configuration 3) The lighting device of Configuration 2, wherein the light from the light source reflected by the first row has a first focal length measured from the center of the first row in the first plane, the light from the light source reflected by the second row has a second focal length measured from the center of the second row in the second plane, and the first focal length is smaller than the second focal length.

(Configuration 4) The lighting device of Configuration 1, wherein each of the plurality of reflective light faces has a convex shape.

(Configuration 5) The lighting device of Configuration 1, wherein each n row of the n by m array has a concave shape or a convex shape.

(Configuration 6). The lighting device of Configuration 4, wherein at least one n row of the n by m array has a concave shape and at least another n row of the n by m array has a convex shape.

(Configuration 7) The lighting device of Configuration 1, where at least one n row of the n by m array has a radius of curvature different than a radius of curvature of the first row.

(Configuration 8) The lighting device of Configuration 6, wherein the second row has a radius of curvature greater than the radius of curvature of the second row.

(Configuration 9) The lighting device of Configuration 1, further comprising a reflecting film disposed on each of the plurality of light reflective faces.

(Configuration 10). The lighting device of Configuration 1, wherein each n row of the n by m array has a topographical profile that is different from a topographical profile of an adjacent n row of the n by m array.

According to any of the embodiments of the present disclosure explained, a lighting device with improved brightness uniformity in the illuminated surface can be provided.

In the description herein, "perpendicular" and "parallel" encompass not only being strictly perpendicular and strictly parallel, but also those including manufacturing tolerances, for example, and thus can be substantially perpendicular and substantially parallel.

Certain embodiments of the present disclosure have been explained above with reference to specific examples. The present invention, however, is not limited to these specific examples. For example, any specific configuration such as an optical part, reflecting part, reflecting face, light source part, or light source included in a lighting device is encompassed by the scope of the present invention so long as it is suitably selected from those available in the public domain by a person having ordinary skill in the art to similarly implement the present invention and achieve similar effects.

Moreover, one combining two or more elements in the specific examples to the technical extent possible also falls within the scope of the present invention so long as it encompasses the subject matter of the present invention.

All other lighting devices implementable by a person having ordinary skill in the art by means of a design change based on the lighting devices described as the embodiments of the present invention above also fall within the scope of the present invention so long as they encompass the subject matter of the present invention.

In addition, a person having ordinary skill in the art would be able to make various modifications and alterations within the scope of the technical ideas of the present invention, and such modifications and alterations are also understood to fall within the scope of the present invention.

What is claimed is:

1. A lighting device comprising:

a first light emitting part comprising a first optical part and a first light source part;

wherein the first optical part includes a first reflecting part and a second reflecting part, a first direction extending from the first reflecting part to the second reflecting part crosses a second direction extending from the first light source part to the second reflecting part, a fourth direction extending from the first light source part to the first reflecting part extending along a first plane which includes the first direction and the second direction, and crosses the second direction, a distance between the first reflecting part and the first light source part is larger than a distance between the second reflecting part and the first light source part, and a light distribution angle of a first-reflecting-part light, that is a portion of a first outgoing light from the first light source part reflected by the first reflecting part, in the first plane is larger than a light distribution angle of a second-reflecting-part light, that is a portion of the first outgoing light reflected by the second reflecting part, in the first plane, wherein a first angle formed by an optical axis of the first-reflecting-part light and the second direction is larger than a second angle formed by an optical axis of the second-reflecting-part light and the second direction, the first-reflecting-part light including a first edge and a second edge in the fourth direction, a first orientation from the second edge toward the first edge is along the fourth direction, the first orientation is same as an orientation from the first reflecting part toward the second reflecting part, the second-reflecting-part light including a third edge and a fourth edge in the fourth direction, a second orientation from the fourth edge toward the third edge is along the fourth direction, the second orientation is same as the orientation from the first reflecting part toward the second reflecting part, and a first position of the first edge in the fourth direction is different from a third position of the third edge in the fourth direction.

2. The lighting device according to claim 1, wherein a light distribution angle of the first-reflecting-part light in a third direction perpendicular to the first plane is larger than a light distribution angle of the second-reflecting-part light in the third direction.

3. The lighting device according to claim 2, wherein the first reflecting part includes a first reflecting face, the second reflecting part includes a second reflecting face, and a light distribution angle of a first-reflecting-face light, that is a portion of the first outgoing light reflected by the first reflecting face, in the third direction is larger than the light distribution angle of the second-reflecting-face light, that is a portion of the first outgoing light reflected by the second reflecting face in the third direction.

4. The lighting device according to claim 3, wherein the light distribution angle of the first-reflecting-face light in the first plane is larger than the light distribution angle of the second-reflecting-face light in the first plane.

5. The lighting device according to claim 3, wherein the first reflecting part further includes a third reflecting face and a fourth reflecting face, the first reflecting face being located between the third reflecting face and the fourth reflecting face in the third direction, and the second reflecting part further includes a fifth reflecting face and a sixth reflecting face, the second reflecting face being located between the fifth reflecting face and the sixth reflecting face in the third direction.

6. The lighting device according to claim 5, wherein the first reflecting part has a protrusions shape in at least one of traveling directions of the first-reflecting-part light, and the second reflecting part has a depressed shape in at least one of traveling directions of the second-reflecting-part light.

7. The lighting device according to claim 5, wherein the first reflecting face is protruded with reference to the third reflecting face, and is protruded with reference to the fourth reflecting face, and the second reflecting face is depressed with reference to the fifth reflecting face, and the second reflecting face is depressed with reference to the sixth reflecting face.

8. The lighting device according to claim 5, wherein the first reflecting face has a depressed shape in a section cut in parallel with the first plane, the first reflecting face has a protrusions shape in a section cut in parallel with a second plane which includes the third direction, the second reflecting face has a depressed shape in a section cut in parallel with the first plane, and the second reflecting face has a depressed shape in a section cut in parallel with the second plane.

9. The lighting device according to claim 8, wherein
the third reflecting face has a depressed shape in a section cut in parallel with the first plane,
the third reflecting face has a protrusions shape in a section cut in parallel with the second plane,
the fourth reflecting face has a depressed shape in a section cut in parallel with the first plane, and
the fourth reflecting face has a protrusions shape in a section cut in parallel with the second plane.

10. The lighting device according to claim 1, wherein
the first optical part further includes a third reflecting part, and
at least one portion of the third reflecting part is located between the first reflecting part and the second reflecting part.

11. The lighting device according to claim 10, wherein
the first optical part further includes a fourth reflecting part, and
at least one portion of the fourth reflecting part is located between the third reflecting part and the fourth reflecting part.

12. The lighting device according to claim 1, wherein
the first optical part includes a first member, and
the first reflecting part and the second reflecting part include a first reflecting film disposed on the surface of the first member.

13. The lighting device according to claim 1, wherein
the first light emitting part illuminates an illuminated surface from one side of the illuminated surface,
the first-light-emitting-part light is incident on a first illuminated region of the illuminated surface,
the second-reflecting-part light is incident on a second illuminated region of the illuminated surface, and
a distance between at least one portion of the first illuminated region and the first light emitting part is smaller than a distance between the second illuminated region and the first light emitting part.

14. The lighting device according to claim 1 further comprising:
a second light emitting part comprising:
a second optical part that includes a second-optical-part reflecting face being continuously curved, and
a second light source part that allows a second outgoing light to be incident on the second-optical-part reflecting face.

15. The lighting device according to claim 14, wherein
the lighting device illuminates the illuminated surface from one side of the illuminated surface,
the first light emitting part illuminates the first illuminated region of the illuminated surface,
the second light emitting part illuminates a third illuminated region of the illuminated surface, and
a distance between at least one portion of the third illuminated region and the second light emitting part is smaller than a distance between the first illuminated region and the first light emitting part.

16. The lighting device according to claim 1, wherein
the first position in the fourth direction is between the third position in the fourth direction and the fourth position in the fourth direction, and
the fourth position in the fourth direction is between the first position in the fourth direction and the second position in the fourth direction.

17. The lighting device according to claim 2, wherein
the first position in the fourth direction is between the third position in the fourth direction and the fourth position in the fourth direction, and
the fourth position in the fourth direction is between the first position in the fourth direction and the second position in the fourth direction.

18. A lighting device comprising:
a first light emitting part comprising a first optical part and a first light source part;
wherein the first optical part includes a first reflecting part and a second reflecting part,
a first direction extending from the first reflecting part to the second reflecting part crosses a second direction extending from the first light source part to the second reflecting part,
a fourth direction extending from the first light source part to the first reflecting part extending along a first plane which includes the first direction and the second direction, and crosses the second direction,
a distance between the first reflecting part and the first light source part is larger than a distance between the second reflecting part and the first light source part, and
a light distribution angle of a first-reflecting-part light, that is a portion of a first outgoing light from the first light source part reflected by the first reflecting part, in the first plane is larger than a light distribution angle of a second-reflecting-part light, that is a portion of the first outgoing light reflected by the second reflecting part, in the first plane,
wherein a light distribution angle of the first-reflecting-part light in a third direction perpendicular to the first plane is larger than a light distribution angle of the second-reflecting-part light in the third direction,
the first-reflecting-part light including a first edge and a second edge in the fourth direction, a first orientation from the second edge toward the first edge is along the fourth direction, the first orientation is same as an orientation from the first reflecting part toward the second reflecting part,
the second-reflecting-part light including a third edge and a fourth edge in the fourth direction, a second orientation from the fourth edge toward the third edge is along the fourth direction, the second orientation is same as the orientation from the first reflecting part toward the second reflecting part, and
a first position of the first edge in the fourth direction is different from a third position of the third edge in the fourth direction.

19. The lighting device according to claim 18, wherein
the first optical part further includes a third reflecting part, and
at least one portion of the third reflecting part is located between the first reflecting part and the second reflecting part.

20. The lighting device according to claim 19, wherein
the first optical part further includes a fourth reflecting part, and
at least one portion of the fourth reflecting part is located between the third reflecting part and the fourth reflecting part.

21. The lighting device according to claim 18, wherein
the first optical part includes a first member, and
the first reflecting part and the second reflecting part include a first reflecting film disposed on the surface of the first member.

22. The lighting device according to claim 18, wherein
the first light emitting part illuminates an illuminated surface from one side of the illuminated surface,
the first-light-emitting-part light is incident on a first illuminated region of the illuminated surface, the second-reflecting-part light is incident on a second illuminated region of the illuminated surface, and a distance between at least one portion of the first illuminated region and the first light emitting part is smaller than a distance between the second illuminated region and the first light emitting part.

23. The lighting device according to claim 18 further comprising:

a second light emitting part comprising:

a second optical part that includes a second-optical-part reflecting face being continuously curved, and a second light source part that allows a second outgoing light to be incident on the second-optical-part reflecting face.

24. The lighting device according to claim 23, wherein the lighting device illuminates the illuminated surface from one side of the illuminated surface, the first light emitting part illuminates the first illuminated region of the illuminated surface, the second light emitting part illuminates a third illuminated region of the illuminated surface, and a distance between at least one portion of the third illuminated region and the second light emitting part is smaller than a distance between the first illuminated region and the first light emitting part.

* * * * *